US010662750B2

(12) United States Patent
Angman et al.

(10) Patent No.: US 10,662,750 B2
(45) **Date of Patent: *May 26, 2020**

(54) METHODS AND ELECTRICALLY-ACTUATED APPARATUS FOR WELLBORE OPERATIONS

(71) Applicant: KOBOLD CORPORATION, Calgary (CA)

(72) Inventors: Per Angman, Calgary (CA); Mark Andreychuk, Calgary (CA); Allan Petrella, Calgary (CA)

(73) Assignee: KOBOLD CORPORATION, Calgary (CA)

( * ) Notice: Subject to any disclaimer, the term of this patent is extended or adjusted under 35 U.S.C. 154(b) by 0 days.

This patent is subject to a terminal disclaimer.

(21) Appl. No.: 16/371,912

(22) Filed: Apr. 1, 2019

(65) Prior Publication Data

US 2019/0226311 A1 Jul. 25, 2019

Related U.S. Application Data

(60) Continuation of application No. 15/612,619, filed on Jun. 2, 2017, now Pat. No. 10,287,866, which is a (Continued)

(51) Int. Cl.
*E21B 23/10* (2006.01)
*E21B 43/26* (2006.01)
(Continued)

(52) U.S. Cl.
CPC ..... *E21B 43/26* (2013.01); *E21B 17/206* (2013.01); *E21B 23/10* (2013.01);
(Continued)

(58) Field of Classification Search
CPC ..... E21B 23/10
(Continued)

(56) References Cited

U.S. PATENT DOCUMENTS 5,209,304 A * 5/1993 Nice ..... E21B 23/10 166/154
5,291,947 A * 3/1994 Stracke ..... E21B 33/1243 166/187
(Continued)

OTHER PUBLICATIONS

International Search Report and Written Opinion, PCT/CA2013/050329 to Angman et al., dated Jun. 11, 2013.

*Primary Examiner* — Taras P Bemko
(74) *Attorney, Agent, or Firm* — Parlee McLaws LLP; C. F. Andrew Lau

(57) ABSTRACT

Embodiments of a bottomhole assembly (BHA) for completion of a wellbore are deployed on electrically-enabled coiled tubing (CT) and permit components of the BHA to be independently electrically actuated from surface for completion of multiple zones in a single trip using a single BHA having at least two electrically-actuated variable diameter packers. One or both of the packers may be actuated to expand or retract for opening and closing off a variety of flowpaths between the BHA and the wellbore, in new wellbores, old wellbores, cased wellbores, wellbores with sleeves and in openhole wellbores. Additional components in the BHA, which may also be electrically—actuated or powered, permit perforating, locating of the BHA in the wellbore such as using casing collar locators and microseismic monitoring in real time or in memory mode.

17 Claims, 17 Drawing Sheets

Related U.S. Application Data division of application No. 14/395,840, filed as application No. PCT/CA2013/050329 on Apr. 29, 2013, now abandoned.

(60) Provisional application No. 61/639,493, filed on Apr. 27, 2012, provisional application No. 61/642,301, filed on May 3, 2012, provisional application No. 61/658,277, filed on Jun. 11, 2012, provisional application No. 61/774,486, filed on Mar. 7, 2013.

(51) Int. Cl.

| | |
|---|---|
| ***E21B 33/12*** | (2006.01) |
| ***E21B 43/1185*** | (2006.01) |
| ***E21B 17/20*** | (2006.01) |
| ***E21B 33/124*** | (2006.01) |
| ***E21B 33/128*** | (2006.01) |
| ***E21B 33/129*** | (2006.01) |
| ***E21B 34/06*** | (2006.01) |
| ***E21B 34/16*** | (2006.01) |
| ***E21B 43/116*** | (2006.01) |
| ***E21B 43/119*** | (2006.01) |
| ***E21B 43/14*** | (2006.01) |
| ***E21B 47/06*** | (2012.01) |
| ***E21B 47/12*** | (2012.01) |

(52) U.S. Cl.

CPC ..... *E21B 33/1204* (2013.01); *E21B 33/124* (2013.01); *E21B 33/129* (2013.01); *E21B 33/1285* (2013.01); *E21B 34/06* (2013.01); *E21B 34/16* (2013.01); *E21B 43/116* (2013.01); *E21B 43/119* (2013.01); *E21B 43/1185* (2013.01); *E21B 43/14* (2013.01); *E21B 47/06* (2013.01); *E21B 47/065* (2013.01); *E21B 47/12* (2013.01); *E21B 47/123* (2013.01); *E21B 47/124* (2013.01)

(58) Field of Classification Search

USPC ..... 166/250.01

See application file for complete search history.

(56) References Cited

U.S. PATENT DOCUMENTS

| | | | | |
|---|---|---|---|---|
| 6,138,764 | A * | 10/2000 | Scarsdale | E21B 23/08 166/117.6 |
| 7,059,407 | B2 | 6/2006 | Tolman et al. | |
| 2004/0040707 | A1* | 3/2004 | Dusterhoft | E21B 17/206 166/279 |
| 2004/0089445 | A1* | 5/2004 | Angman | E21B 17/06 166/98 |
| 2004/0188093 | A1* | 9/2004 | Funchess | E21B 43/08 166/299 |
| 2008/0263848 | A1* | 10/2008 | Andreychuk | E21B 17/206 29/428 |
| 2013/0213646 | A1 | 8/2013 | Angman et al. | |
| 2014/0158369 | A1* | 6/2014 | Radford | E21B 23/10 166/373 |

* cited by examiner 10
12
22f
82
90
P
P
92
30
16
18
C
P

12
F
34
50
#15
64
66
82
#14
90
P
C
22f
P 38
12
36
34
30
50
58
F
F
56
46
P
P
C
22f
82
34
90

| BHA | WELLBORE TYPE | | | MONITOR FRACTURE | BHA CONFIGURATION |
|---|---|---|---|---|---|
| | NEW SLEEVES | NEW NO SLEEVES | OLD | | |
| 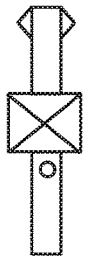 | √ | | | | First packer and CCL |
| 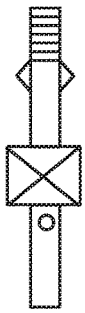 | √ | √ | | | First packer, CCL and perforating apparatus |
| 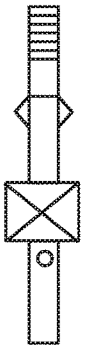 | √ | √ | | √ | First packer, CCL, fracture monitoring and perforating apparatus |
| 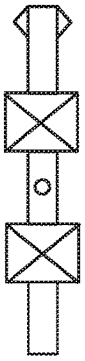 | √ | | √ | | First and second packer, CCL and perforating apparatus |
| 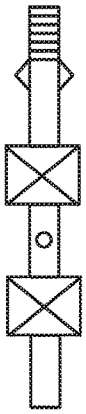 | √ | √ | √ | | First and second packer, CCL and perforating apparatus |
| 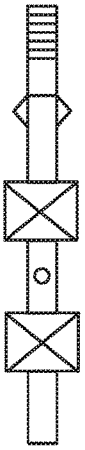 | √ | √ | √ | √ | First and second packer, CCL, fracture monitoring and perforating apparatus |

*Fig. 10*

METHODS AND ELECTRICALLY-ACTUATED APPARATUS FOR WELLBORE OPERATIONS

CROSS REFERENCE TO RELATED APPLICATIONS

This application is a continuation of U.S. application Ser. No. 15/612,619, filed Jun. 2, 2017, which is a divisional application of U.S. Ser. No. 14/395,840 filed Oct. 21, 2014 as a 371 from international PCT/CA2013/050329, filed Apr. 29, 2013, which claims the benefit of U.S. Provisional Application 61/639,493, filed Apr. 27, 2012; and of U.S. Provisional Application 61/642,301, filed May 3, 2012; and of U.S. Provisional Application 61/658,277, filed Jun. 11, 2012 and of U.S. Provisional Application 61/774,486, filed Mar. 7, 2013, the entirety of which are incorporated fully herein by reference.

FIELD

Embodiments of the disclosure relate to methods and apparatus used for completion of a wellbore and, more particularly, to methods utilizing electrically-actuated apparatus for performing completion operations and optionally, simultaneous microseismic monitoring thereof.

BACKGROUND

Apparatus and methods are known for single-trip completions of deviated wellbores, such as horizontal wellbores. To date, unlike the drilling industry which commonly utilizes intelligent apparatus for drilling wellbores, particularly horizontal or deviated wellbores, the fracturing industry has relied largely on mechanically-actuated apparatus to perform at least a majority of the operations required to complete a wellbore. This is particularly the case with coiled-tubing deployed bottom hole assemblies (BHA's), largely due to the difficulty in providing sufficient, reliable electrical signals and power from surface to the BHA and from the BHA to surface.

It is known to deploy BHA's for completion operations using jointed tubular, wireline or cable and using coiled tubing (CT). Further it is known to use wireline deployed within an interior of CT to actuate conventional select-fire perforation charges and to transmit signals associated with casing-collar locators used in depth measurement such as taught in U.S. Pat. No. 7,059,407.

As new resources are being developed, the industry has an interest in fracturing operations in horizontal wells, such as wellbores which may have minimal vertical portions and very long horizontal wellbores. Use of coiled tubing to deploy conventional BHA's, particularly using small diameter CT, is problematic in such wellbores as one cannot easily run in CT to the toe of the very long horizontal wellbores.

Generally, a conventional BHA for use with CT and used for completion of new wellbores incorporates a jetting sub for perforation of casing or the wellbore wall and a single sealing element, such as a resettable bridge plug, for sealing the wellbore below the jetted perforations for treating the formation therethrough. The treatment fluid, such as a fracturing fluid, is then pumped through the annulus between the casing and the CT, or through the bore of the CT, or both.

In the case of previously perforated wellbores, a separate BHA is used which incorporates two spaced-apart sealing elements, such as packer cups or mechanically-set or hydraulically-set packers, which straddle the existing perforations. Treatment fluid is delivered through the bore of the CT to be delivered to the perforations isolated between the sealing elements.

Prior art tools used for performing fracturing operations at multiple zones in a formation have used wireline deployed, electrically-actuated bridge plugs which are pumped into the wellbore. The known pump-down bridge plugs have a single, fixed diameter being slightly smaller than the wellbore for deployment into the wellbore and require a valve at a toe of the wellbore to get rid of fluid used to pump the bridge plug into place. As wireline is comparatively weak and cannot pull more than about 2500 lbs at surface, and much less at depth, the wireline cannot be reliably used to release or to pull the bridge plugs to surface. Thus, multiple bridge plugs must be used and left in the wellbore to be drilled out later, at considerable expense. After the bridge plug has been set, the casing is perforated with perforating guns located above the bridge plug. The bridge plug and the perforating guns are often deployed together so that both operations, isolating and perforating, can be done in the same wireline run. When the perforations have been shot, the wireline is pulled out of the hole and the fracture fluid is pumped through the casing. Once the fracture is completed, the steps of setting the bridge plug and perforating followed by pumping the frac are repeated for sequential uphole intervals until the fracturing job on the wellbore is complete. This method is commonly referred to as "plug and perf". Following fracturing of all of the zones, the bridge plugs are drilled out.

Conventional perforating guns are also incorporated into BHA's which are used for completion of new wellbores. Typically, conventional perforating guns utilize detonation cord for connecting between and actuating a plurality of spaced apart shaped charges therein which results in a very long perforating gun. Generally, in embodiments of conventional operations, it is desirable to perforate as many zones as possible in a single run. In order to maximize the number zones which can be perforated, very long conventional select-fire perforating guns are required. The length of the perforating guns impacts conventional operations, requiring very tall cranes and other support apparatus to hold and inject the very long gun assemblies and BHA into very tall lubricators, often exceeding about 30 meters. In many cases, the number of zones which can be perforated in a single trip is limited to permit a reasonable length for the BHA and lubrication apparatus.

In many cases, at least two separate BHA's are required when operators are fracturing both new wellbores and previously perforated wellbore. In the case of new wellbores, once perforations are formed or a sliding sleeve is actuated to open pre-existing ports in the casing, a single isolation apparatus is used to seal the annulus therebelow to isolate the newly-formed perforations to be treated from the previous perforations formed therebelow. Treatment fluid can be delivered to the formation through the annulus between the casing and the ct, or, in some cases, through the CT, or through both at the same time. In the case of old wellbores having previously formed perforations or opened ports therein, particularly where sleeves cannot be actuated to close, two spaced apart isolation apparatus are required to straddle the perforations or ports to be treated and treatment fluid is delivered through the tubing string to the isolated perforations or ports therebetween.

As will be appreciated by those of skill in the art, monitoring pressure downhole during fracturing operations is indicative of how the formation is reacting to the fracturing operation and may also be indicative of the integrity of the isolation apparatus and the formation between adjacent zones. Generally, downhole pressures are not monitored directly, but instead are calculated from parameters measurable at surface. For example, when treatment fluid is delivered to the formation through one or the other of the annulus or the tubing string, the other can act as a "dead leg". For example, when the treatment fluid is delivered through the annulus, a minimal, constant amount of a deadhead fluid is delivered through the tubing string to act as the "dead leg", maintaining pressure within the tubing string. The pressure required to maintain the constant fluid delivery is monitored from surface and can be used for calculating fracture extension pressure and formation breakdown pressure, as well as fracture closure pressure.

It is known to use microseismic monitoring where operators wish to monitor fracture growth and development, either in real time or retroactively to optimize subsequent fracturing operations. Prior art systems typically require a conveniently located offset observation wellbore and wireline truck to deploy an array of sensors in the observation wellbore, which can monitor the fracturing operation. Alternatively, an extensive microseismic surface array may be used. Both systems benefit from use of a multi-string shot tool (MSST) for creating known microseismic events as a result of detonation of string shots therewith at known locations in the wellbore to aid in developing more accurate velocity profiles and calibrating the sensors.

Clearly, there is great interest in the industry to develop tools which enable completion of multiple zones in a single trip while optimizing the apparatus required and reducing cost and operational man hours. There is a further interest in apparatus and methods for improving the ability to accurately monitor fracture growth and placement for optimizing fracturing operations. Further, there is interest in developing tools having diagnostic capabilities that would greatly improve the reliability of the tools and processes used.

SUMMARY

Embodiments of systems and methods for completion of a wellbore disclosed herein utilize electrically-enabled coiled tubing for bidirectional communication of signals between a bottomhole assembly (BHA) and surface and for providing power to the BHA components which can be electrically actuated or a combination of electrically-actuated and mechanically-actuated components. The BHA comprises at least one electrically-actuated, variable diameter packer located below treatment ports and which is substantially infinitely variable with respect to diameter within the limitations of the actuation mechanism. The packer has elements which can be expanded to seal the wellbore, to act as a piston for pumping the BHA downhole and for pulling the CT therewith, or to fully retract and at any diameter therebetween.

When the BHA further comprises two or more, spaced apart, variable diameter packers, positionable on either side of treatment ports, the packers can be individually controlled with respect to diameter for opening and closing a variety of fluid pathways between the wellbore and the BHA having functionality heretofore impossible with conventional completion tools.

In embodiments, the BHA can further comprise additional components such as perforating apparatus, casing collar locators for locating within cased and lined wellbores, microseismic sensors, fiber optics, sensors for directly measuring pressure, temperature, vibration, strain and other parameters related to the BHA and completion operation. The further components can be electrically-actuated or powered or can be mechanical or combinations thereof.

BRIEF DESCRIPTION OF THE DRAWINGS

FIG. 2A illustrates elements of the packer expanded to a slightly smaller diameter than an inner diameter of a wellbore in which the centralized packer is being pumped downhole by fluid drive;

FIG. 2B illustrates elements of the packer retracted to permit passage of the packer by debris in the wellbore in which the centralized packer is being pumped downhole; and FIG. 2C illustrates elements of the packer fully retracted to permit pulling the packer uphole in the wellbore;

FIG. 5A illustrates selective actuation of a segment of the perforating gun for forming a perforation uphole from a previous perforation in a wellbore;

FIG. 5B illustrates repositioning of the BHA to position the variable volume packer below the perforations created in FIG. 5A; and FIG. 5C illustrates fracturing through the perforations created in FIG. 5A and above the packer, fracturing fluid being delivered through the coiled tubing for delivery from fracturing ports in the BHA to the perforations;

FIG. 5D illustrates reverse circulation of debris from the annulus to surface after fracturing, clean fluid being delivered through the annulus to the fracturing ports and open fluid path in the valve for circulation of debris to surface;

FIG. 10 is a table representing a variety of embodiments of the BHA according to embodiments disclosed herein.

DETAILED DESCRIPTION

Figure 1A:
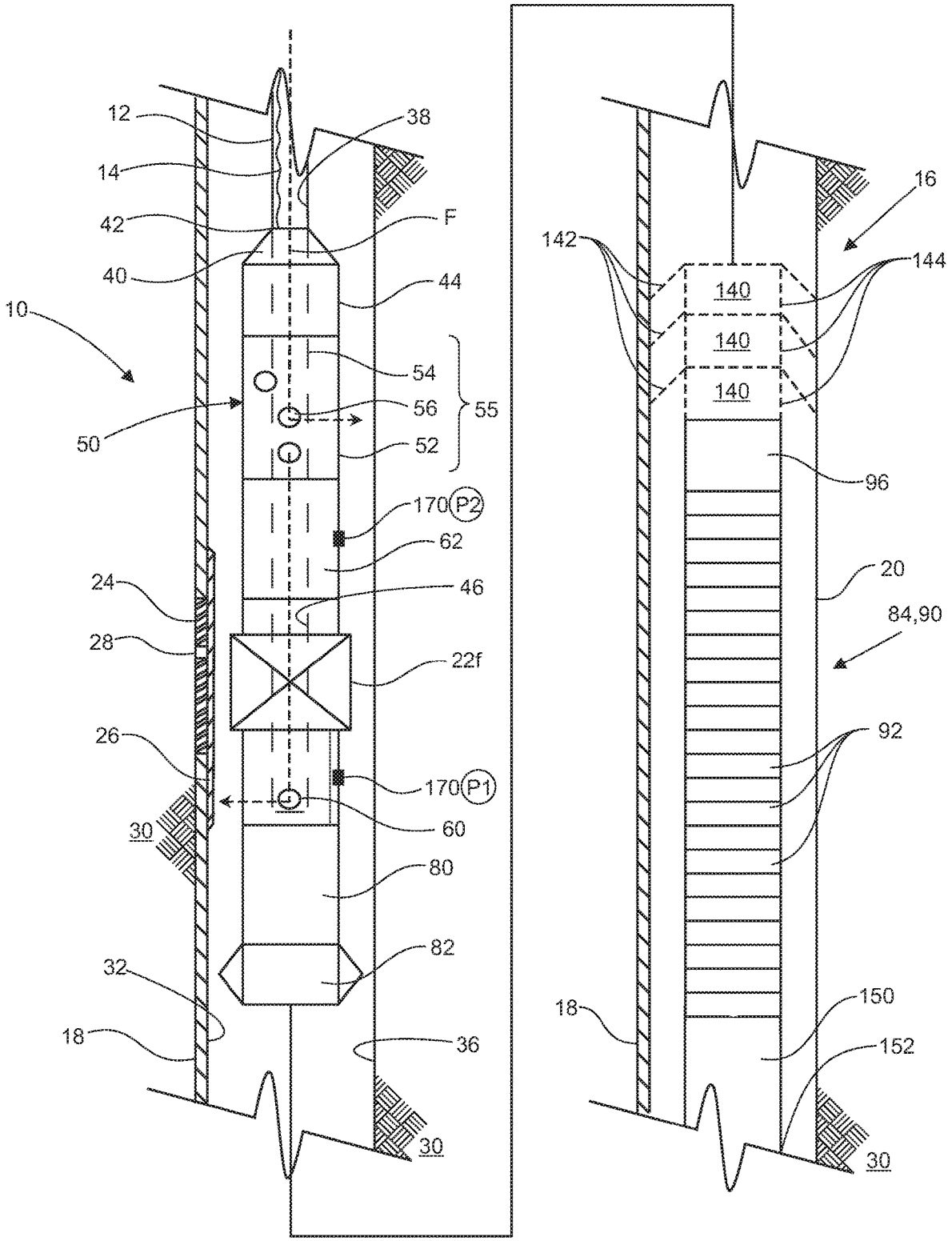
FIG. 1A is a representative illustration of a bottomhole assembly BHA according to an embodiment of the disclosure and having a single, variable diameter packer incorporated therein.

Embodiments are described herein in the context of fracturing however as one of skill in the art will understand, systems and methods disclosed herein are also applicable to other completion and stimulation operations.

Embodiments described herein utilize electrically-actuated downhole tools incorporated into a bottom-hole assembly (BHA) for completion of multiple zones of interest in a formation during a single trip into the wellbore. Use of electrically-actuated BHA components permits functionality heretofore not seen in conventional, mechanically-actuated BHA components. In embodiments, separate electrically-actuated drive components permit independent operation of optimal BHA components, used individually or in combination, such as isolation apparatus, perforating apparatus, fracturing subs, microseismic monitoring apparatus, and the like. Further, use of the electrically-actuated tools allows the BHA to be more compact than conventional BHA's used for the same purposes, suitable for lubricator deployment. One further advantage is that tools incorporated in the BHA, such as perforating guns, actuated electrically from surface provide accurate times of perforation and actuation of fracturing operations which aid in more accurate microseismic monitoring of fracture growth and placement.

In embodiments, most, if not all, of the components of the BHA are electrically actuated. In other embodiments, only some of the components are electrically actuated for maximal advantage and are used together with mechanically-actuated components.

While applicable to a variety of wellbore types, apparatus and methods described herein are particularly suitable for deviated, horizontal or directional wellbores and particularly those of very long or extended length.

The terms "uphole" and "downhole" used herein are applicable regardless the type of wellbore; "downhole" indicating being toward a distal end or toe of the wellbore and "uphole" indicating being toward a proximal end or surface of the wellbore. Further, the terms "electronically-actuated" and "electrically-actuated" are used interchangeably herein and may be dependent upon the characteristics of the component being actuated.

Bottom hole apparatus (BHA) 10, according to embodiments described herein, are deployed on coiled tubing (CT) 12. Bi-directional communication for actuation of the electrically-actuated tools from surface and receipt of data therefrom is possible using electrically-enabled CT 12, such as described in co-pending, US published application US2008/0263848 to Andreychuk, referred to herein as electrically-enabled CT. Electrical conductors 14, such as a wireline, multi-conductor cables, fiber optic cables and combinations thereof are retained to an inner wall of the CT 12 to avoid problems associated with loosely hanging cabling and to permit reliable and resilient reeling and unreeling of the CT 12 during repeated operations. In an embodiment multiple conductors 14 are surrounded by an outer insulated sheath for forming a protected cable for welding directly to the inner wall of the CT 12, and heat treated together with the CT 12 during manufacturing prior to use. The electrically-enabled CT can be used to simultaneously conduct fluid as well as electrical service pulses and signals, as well as power.

As one of skill in the art will understand, any electrically-enabled CT 12, which provides sufficient electrical capability to actuate components in the BHA 10 as well as permits bi-directional communication between the BHA 10 and surface, would be suitable for use in embodiments described herein.

Applicant believes that fracturing operations are particularly useful in horizontal wells, such as wellbores 16 which have minimal vertical portions and very long horizontal wellbores, for example, wellbores with horizontal portions extending to at a measured depth of at least 23,000 feet in the Williston Basin, an area which extends from southern Saskatchewan and Manitoba, Canada into Montana, North Dakota and South Dakota, USA. Further, fracturing operations can be performed on offshore wellbores. Coiled tubing (CT) 12 can be used in such operations. The diameter of the CT 12, and the length of the horizontal wellbore 16 which can be accessed using conventional CT-deployed apparatus and methodologies, are largely dictated by the displacement required to push the CT 12 into the very long wellbores 16. Embodiments disclosed herein permit use of relatively small diameter CT 12, such as 1½ inch electrically-enabled CT to deploy the BHA 10 to the toe of a very long wellbore 16. Further, use of CT 12, unlike pulling limitations of conventional wireline, can exert much higher pulling forces depending upon the CT size and material specifications, being sufficient to raise the BHA 10 therefrom to surface S.

Embodiments described herein are useful for treating or fracturing new wellbores 16, both completed with casing 18 and open-hole wellbores 20, or previously perforated cased wellbores 16, or open-hole wellbores.

More particularly, an embodiment comprising first and second separately controllable, spaced apart electrically-actuated variable diameter packers **22*f*, 22*s*, operated as described in greater detail below, can be used for operations in both new and old wellbores using a single BHA 10. The first and second packers 22*f*, 22** are substantially infinitely variable with respect to diameter within the limitations of the actuation means.

Embodiments described herein are used to select an optimal fracturing operation such as that which permits reducing pumping rates and volumes compared to conventional pumping rates and volumes. Often the pumping rates are set by the large size of CT used to access the total depth of the wellbore. Using embodiments describe herein permits reducing the diameter of the electrically-enabled CT 12 compared to conventional CT used for fracturing. Using conventional apparatus and methodologies, reductions in diameter of the CT 12 to a small diameter CT 12 has presented difficulties as the small CT 12 is difficult to push to the toe of very long wellbores 16.

Single Packer Embodiments

Figure 1B:
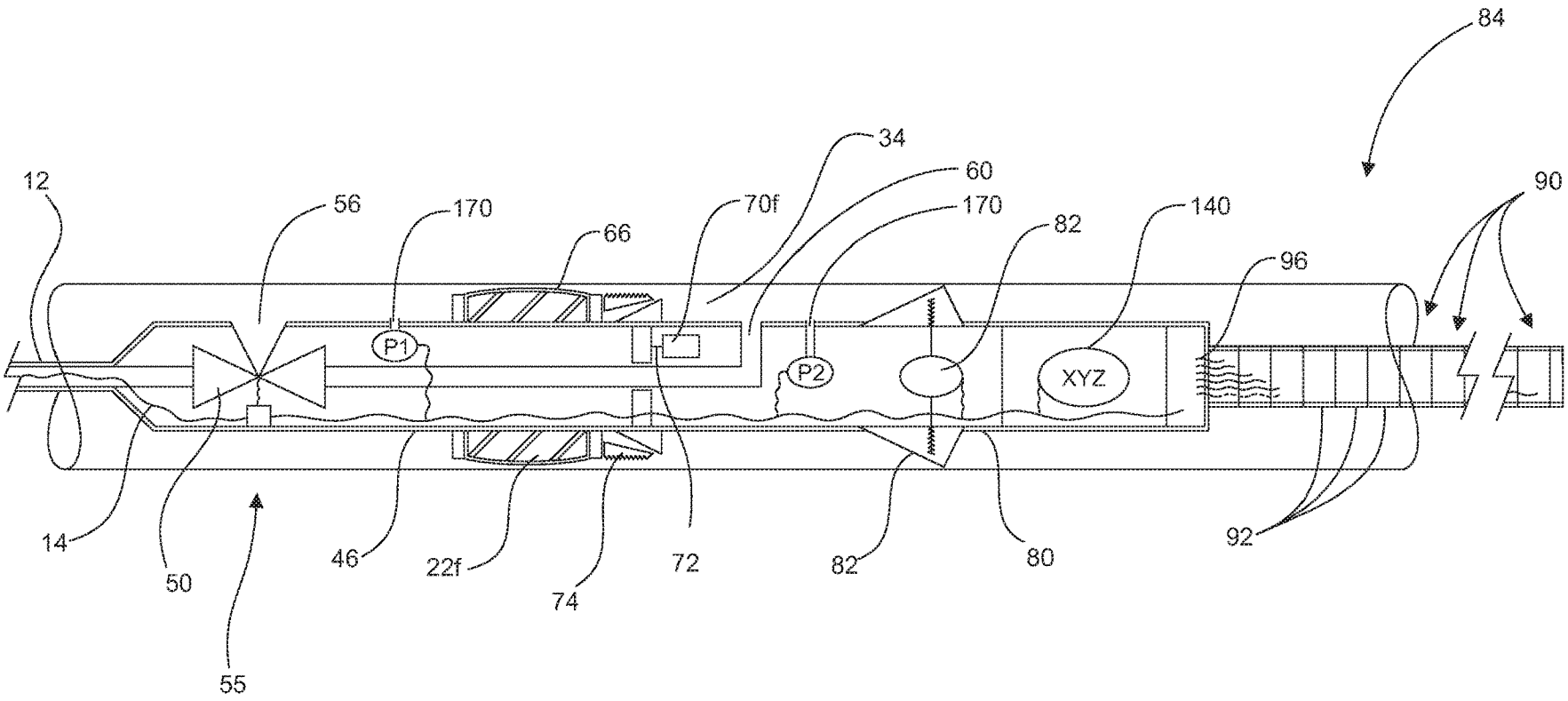
FIG. 1B is a fanciful cross-sectional view according to FIG. 1A.

Having reference to FIGS. 1A and 1B, a bottom-hole assembly (BHA) 10 deployable using electrically-enabled coiled tubing 12, is shown. When deployed into the wellbore 16, being cased 18, an annulus 34 is formed between the BHA 10 and the casing 18. The electrically-enabled CT 12 is capable of conducting fluid F through a bore 38 extending therethrough as well as electrical pulses and signals through the conductors 14 retained therein.

Beginning at a proximal end 40, the BHA 10 comprises at least a fracturing head 55, having a plurality of fracturing ports 56 and an electrically-actuable valve 50 therein and a first electrically-actuated variable diameter packer 22*f* positioned therebelow.

In an embodiment the BHA 10 is fluidly connected to a distal end 42 of the electrically-enabled CT 12 through a ball-actuated release sub or disconnect 44 as is understood in the art. Electrical connection between the electrically-enabled CT 12 and the BHA's components therebelow can be accomplished in a number of ways, including but not limited to conductors extending therefrom through a bore 46 of the BHA 10 or conductors extending therefrom through an electrical race formed about a periphery of the BHA's components.

The fracturing head 55 comprises the valve 50, such as an electrically-actuated solenoid valve. Best seen in FIG. 1B the valve 50 is fluidly connected to the bore 38 of the electrically-enabled CT 12 through the ball-actuated disconnect 44. The valve 50 comprises a housing 52 having a throughbore 54 formed therethrough contiguous with the bore 38 of the CT 12 and the bore 46 of the remainder of the BHA 10 therebelow. The plurality of fracturing ports 56 extend radially outwardly from the throughbore 54 through the housing 52 for delivery of fluid F therethrough.

The valve 50 can be electrically-actuated to a first position to divert fluids F, flowing from the CT 12 through the plurality of fracturing ports 56. When actuated to a second position, the valve 50 permits the flow of fluids F in the throughbore 54 to be delivered through the bore 46 of the BHA 10 therebelow and to the annulus 34, such as through a fluid crossover port 60. Valve 50 could be configured to isolate the throughbore 54 from the annulus The valve 50 is operatively connected to an electric valve drive 62 which receives signals from surface through the electrically-enabled CT 12 for controlling the position of the valve 50.

Having reference to FIGS. 1B and 2A-2C, the BHA 10 further comprises the first variable diameter packer 22*f* operable between at least two positions: sealed to the wellbore or undersized for pumping. When in the sealed position the first packer 22*f* functions to seal the annulus 34 between the BHA 10 and the casing 18 or wellbore wall 36 when actuated to expand to a sealing diameter. The first packer 22*f* further comprises slips for anchoring the first packer 22*f* in the wellbore which are actuated to engage the casing 18 or wellbore 16 when the first packer 22*f* is expanded to the sealing diameter.

In the second position, the first variable diameter packer 22*f* is sized to a running position, forming an uphole piston face 64 when expanded to a running diameter, being greater than a minimum packer diameter when the packer 22*f* is in a third, fully retracted position, and less than a diameter of the casing 18 or wellbore 16. In the running position, the running diameter of the first packer 22*f* is sized to just under casing drift. Fluid F is pumped through the annulus 34 against the uphole piston face 64 to push the first packer 22*f*, and BHA 10 connected thereto, downhole.

The running diameter is variable and depends upon a number of variables such as friction, horizontal length of the wellbore 16, the size and parameters related to the CT, the weight of the BHA and the like. In general the running diameter is the smallest diameter which works to effectively move the BHA 10 downhole with sufficient pulling force to pull the CT 12 therewith.

The BHA can be fit with a strain gauge (not shown) which can measure axial load in the BHA 10 to assist the operator to understand if the piston force on the first packer 22*f* is too high and also to understand where resistance may be coming from, being either from debris in the wellbore 16 or as a result of drag friction of the CT 12. As one of skill in the art will appreciate, the strain gauges or sensors provide data to surface through the CT 12 to assist with determining an appropriate balance between injection rates and pumping rates to avoid pulling the BHA 10 apart. In, other words, the CT and BHA form an injection string, the system further comprising a strain sensor along the injection string uphole of the packer, such as in the BHA 10 above the packer 22*f*, the strain sensor electrically connected to the CT for providing signals indicative of axial loading in the string at about BHA. A controller is provided for receiving axial loading signals and for managing a rate of injection of the CT and a rate of pumping of the BHA for managing the axial loading. The controller is typically located at surface.

Further, the wellbore 16 might be fit with a toe burst sub (not shown) to enable pump down so that fluid displaced below the first packer 22*f* can be pushed into the formation 30 at the toe of the wellbore 16. The CT 12 is pulled therewith for positioning the BHA 10 at zones of interest in the formation 30 over very long horizontal wellbores, the BHA 10 placing the CT 12 in tension and effectively conveying the CT 12 long distances. Further, with the first packer 22*f* expanded to the running diameter, the BHA 10 can be lifted in the wellbore using the CT 12 for repositioning the BHA 10 within the wellbore 16 during fracturing from toe to heel. The first variable diameter packer 22*f* can be reduced to the third minimum packer diameter, such as for tripping out of the wellbore 16.

In an embodiment, the first variable-diameter packer 22*f* has an electronically-actuated packer element 66 for varying the diameter of the first packer 22*f*. The first packer 22*f* is positioned below the valve 50 and above the fluid crossover port 60 in the BHA 10. Thus, when the valve 50 is actuated to do so, fluid F flows through the throughbore 54 to below the first variable-diameter packer 22*f* and outwardly to the annulus 34 therebelow though the fluid crossover port 60.

The first variable diameter packer 22*f* is electrically actuated, having a drive sub 70*f*. The first packer drive sub 70*f* receives signals from surface S for electronically actuating the packer element 66 for varying the diameter of the first variable-diameter packer 22*f*. In an embodiment, an electric motor 72 electrically connected to the drive sub 70*f* can be used for accurate and fine control of the packer diameter. In an embodiment, the electric motor 72 can drive conical actuators 74, swash plates or other means, for engaging and expanding the packer element 66. In an embodiment, an electric motor and linear screw actuator are used to drive the conical actuators 74. Means are provided for reducing friction and for adjusting the gear ratio between a gear ratio for light load over much of the actuators stroke and a high gear ratio, such as about 1:250, when the actuator engages the conical actuators 74.

An electronics sub 80 comprising at least electronics for monitoring a pressure P2 below the first packer 22*f* and for optionally monitoring a pressure P1 above the first packer 22*f*, is also incorporated into the BHA 10, such as below the first packer 22*f* and the first packer drive sub 70.

For location of the BHA 10 within the wellbore 16, the BHA 10 further comprises an electronic casing collar locator (CCL) 82 which is capable of detecting casing collars and which may also be capable of detecting perforations. The electronics sub 80 also comprises electronics associated with the operation of the CCL 82. The electronically-actuated CCL 82 is useful throughout the completion operation for accurately determining the positioning of the BHA 10 in the wellbore 16.

Alternatively, in embodiments, a mechanical CCL can be used.

Perforation Option

In a general tool for simple cased or lined wells 16 or as a backup to failed sleeved subs, an electronically-actuated perforating apparatus 84 is also incorporated into the BHA 10. Such perforating apparatus 84 may comprise an electronically-detonated, selectively-actuated perforating gun assembly 90, such as shown in FIGS. 3A-3F, or alternatively may comprise perforating apparatus which are electronically or electro-mechanically-actuated to mechanically punch or drill through the casing 18 or liner for creating perforations therein.

In embodiments, as shown in FIGS. 1A and 1B, an electronically-detonated selectively-actuated perforating gun assembly 90 can be mounted adjacent a distal end 152 of the BHA 10. While any type of selectively-actuated perforating gun can be used, embodiments described herein utilize a perforating gun 90 having a plurality of segments 92 which are wired in such as way as to permit each segment 92 to be detonated selectively and individually, such as from a firing panel 94 at surface (FIG. 4) as described in greater detail below.

In embodiments, a magnet 150 may optionally be mounted at the distal end 152 of the BHA 10 for picking up metallic debris in the wellbore 16, such as during run in.

Microseismic Monitoring Option

Optionally, where fracturing of the formation 30 is monitored using a microseismic fracture monitoring system, one or more seismic sensors 140, such as axially-spaced, 3-component (x, y, z) geophones, are also incorporated into the BHA 10. The one or more 3-component sensors 140 are incorporated in the BHA 10 between the first packer 22*f* and the perforating gun assembly 90.

In embodiments, each seismic sensor 140 is coupled to the casing 18 or wellbore wall.

In an embodiment, each sensor 140 has elements or arms 142 which can be actuated, such as electronically, to contact the casing 18 or wellbore wall 36 for seismically coupling the sensors 140 thereto and enhancing signal detection when the BHA 10 is positioned for fracturing. The arms 142 can be retracted any time the BHA 10 is to be moved within the wellbore 16 or removed therefrom.

Alternatively, each sensor 140 comprises conventional centralizers (not shown) which extend outwardly from the sensors 140 and which act to couple the sensors 140 to the casing 18 or wellbore wall.

In order to accurately determine the position of a microseism resulting from a fracturing operation, one must know the orientation of the one or more sensors 140 and therefore means are provided to ensure that the sensors 140 are either oriented in a known orientation when landed or that any resulting orientation can be determined, in real time or in a memory mode, so as to permit the data to be mathematically manipulated.

In an embodiment, each of the sensors 140 is pivotally mounted within the BHA 10 and a housing 144 for each sensor 140 is weighted to ensure that the sensor 140 orients to a known orientation when deployed in the wellbore, such as prior to extending the arms 142 for coupling the sensor 140 in the wellbore 16. Alternatively, the weighting of the housing causes the sensors 140 to rest on the casing or wellbore wall and no additional coupling apparatus is required.

Alternatively, in another embodiment, each of the sensors 140 has position sensors, such as accelerometers or MEMS sensors, which are capable of providing signals to surface, or to a downhole processor with a battery and memory, regarding the orientation of each of the sensors 140. The data from the sensors 140 is then mathematically manipulated with respect to the orientation of the sensors 140, as is understood in the art.

Details of embodiments comprising the microseismic monitoring option are discussed in greater detail below.

Electrically Actuated Variable Diameter Packers

In greater detail, and having reference again to FIGS. 2A-2C, in embodiments, in order to move the BHA 10 deployed on small diameter electrically-enabled CT 12 to the toe of very long wellbores 16, the packer element 66 of the first variable diameter packer 22*f* is expandable and retractable for varying the outer diameter. One position for the first packer 22*f* is to act as a piston and be effectively pumped downhole, pulling the small diameter electrically-enabled CT 12 therewith. The first packer 22*f* is centralized in the wellbore, such as using conventional centralizing elements 124. When inserted into the wellbore, the packer element 66 of the first packer 22*f* is electronically actuated to at least two positions: to seal as a packer and to act as a piston for pumpdown purposes and could include a third position, being fully retracted to minimize accidental engagement and damage. In the second, pumpdown position the packer element 66 is expanded in diameter to the running diameter, being a diameter less than a diameter of the wellbore 16. The increased packer diameter permits effective generation of substantially maximal fluid force on the BHA 10. Fluid F is pumped through the annulus 34 to act at the uphole piston face 64 of the first packer 22*f* for pushing the first packer 22*f* and BHA 10, and for pulling the electrically-enabled CT 12 therewith, to adjacent a toe of a very long wellbore 16. For example using 2000 psi and a 12 square inch packer face, as is the case for 4½ inch diameter casing 18, a 24,000 lb force is generated which can push the first packer 22*f* and BHA 10 to the toe of about a 4000 m TVD wellbore 16. Depending upon the size and type of CT 12 used about 50,000 lbs to about 150,000 lbs of pulling force can be exerted to raise the BHA 10 to surface S.

Figure 2A:
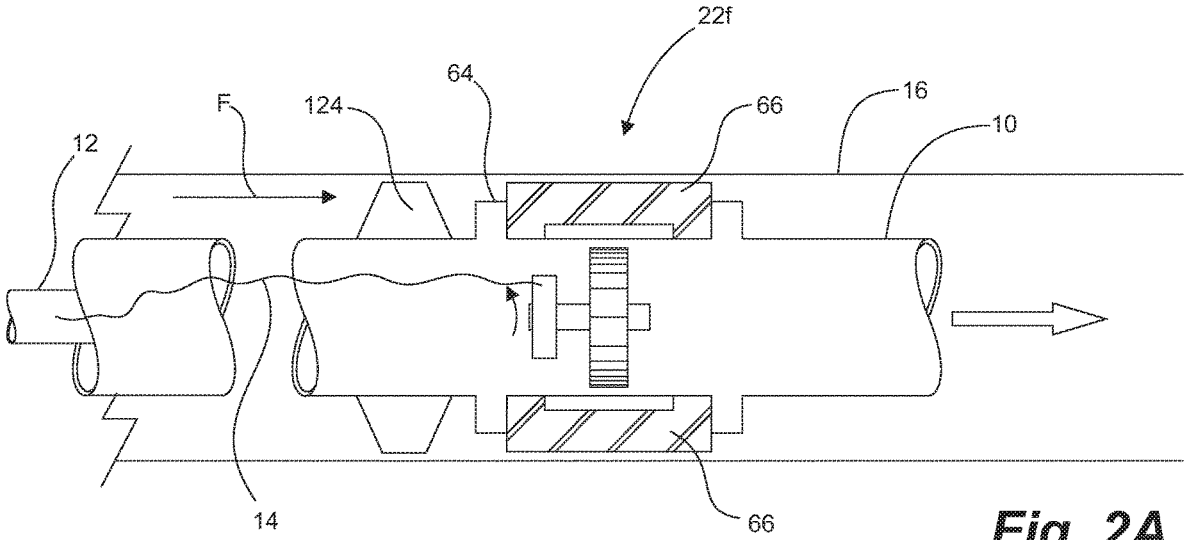
FIGS. 2A-2C are fanciful cross-sectional views of a variable diameter packer according to FIG. 1A; more particularly.
Figure 2B:
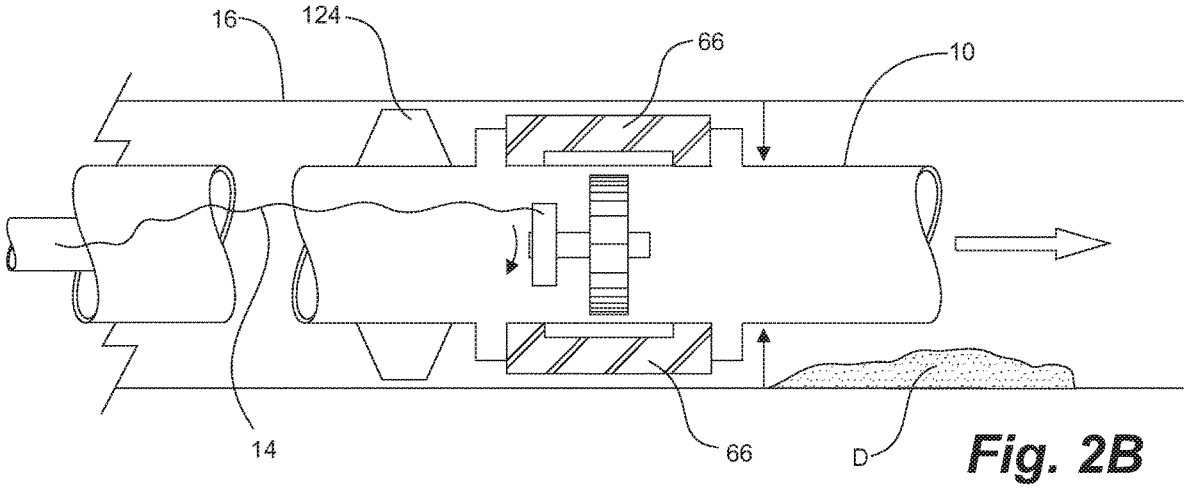
Figure 2C:
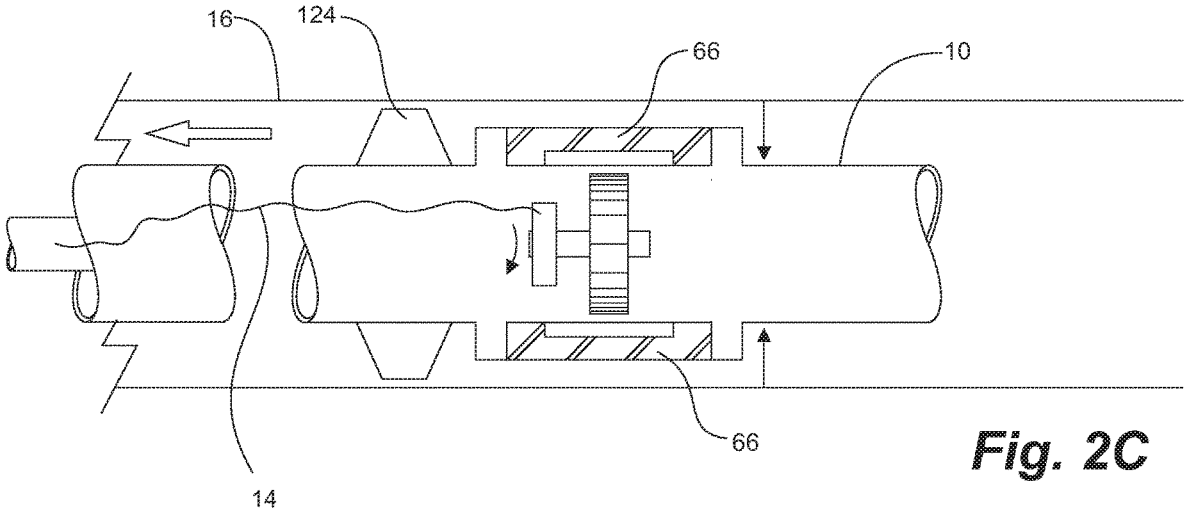

Advantageously, as shown in FIG. 2B, the packer element 66 of the first variable diameter packer 22*f* can also be temporarily varied in diameter to a third smaller diameter than the running diameter to run past debris D encountered in the wellbore 16. Should there be an indication at surface that the BHA 10 is not advancing in the wellbore 16, the diameter can be controllably reduced, actuated electronically, such that the first packer 22*f* and the BHA 10 can pass the debris D, after which the diameter of the first packer 22*f* can once again be increased to the pumpdown or running diameter for achieving substantially maximum axial displacement. As shown in FIG. 2C, the first packer 22*f* can also be actuated to the third position for a smallest or minimum packer diameter for tripping out of the wellbore 16.

Selectively-Fired Electrically Actuated Perforating Gun

Having reference to FIGS. 3A to 3F and 4, in an embodiment, the selectively-actuated perforating gun 90 comprises the plurality of segments 92 which are operatively connected to the electrically-enabled CT 12 through a top connector sub 96 at a proximal end 98 of the perforating gun 90.

Figures 3A, 3B:
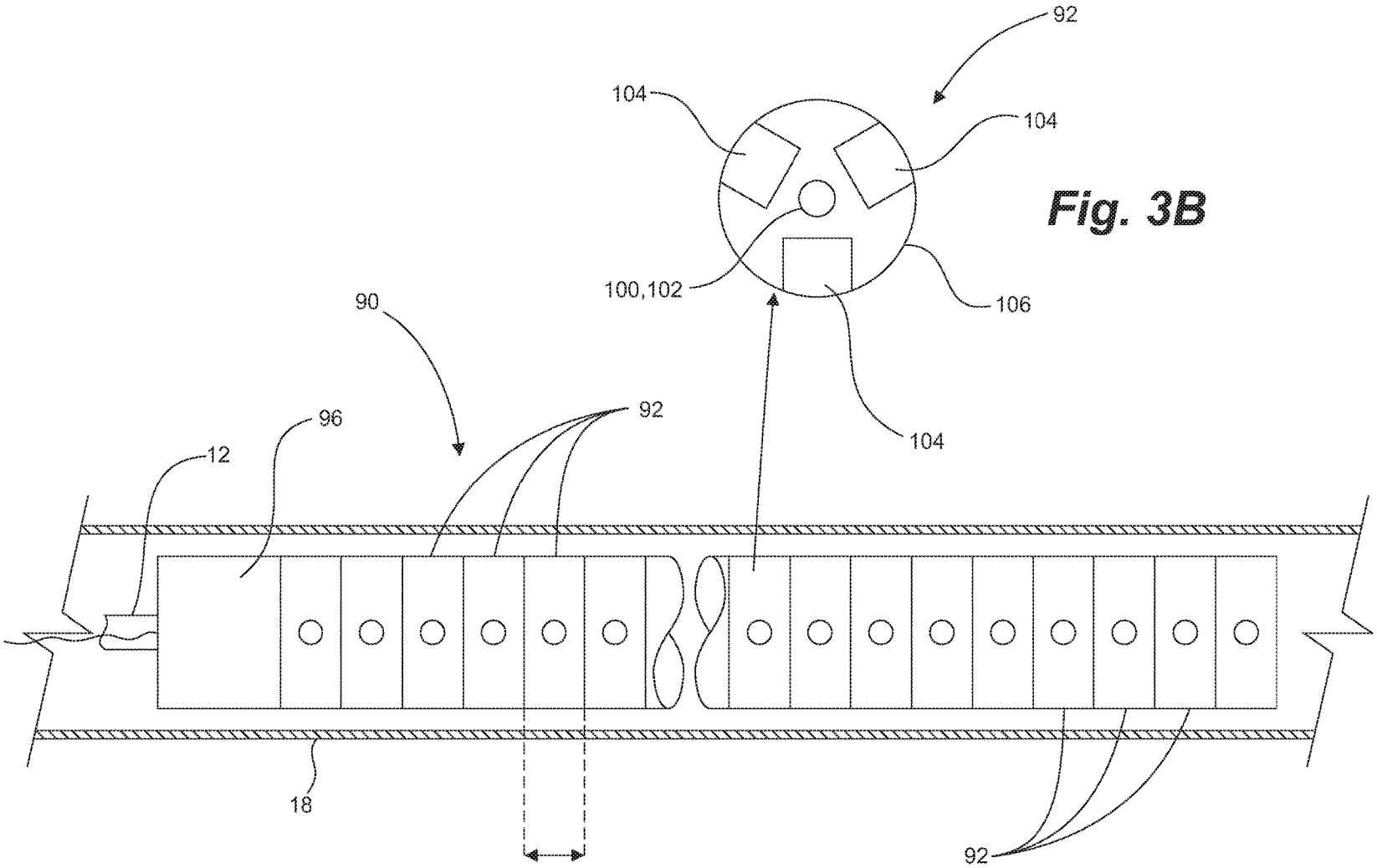
FIG. 3A is a representative illustration of a selectively actuated perforating gun incorporated in a BHA according to FIG. 1A.
FIG. 3B is a cross-sectional view according to FIG. 3A.

As shown schematically in FIG. 3B and in greater detail in FIGS. 3C to 3F, each segment 92 comprises a detonator 100 and an electronically-actuated triggering means 102, such as a built in electronic switch, and one or more shaped charges 104. In embodiments, the electronic switch 102 is built into a detonator housing 106 in which the detonator 100 is mounted. The one or more shaped charges 104 are mounted radially about the detonator housing 106. Where two or more shaped charges 104 are used, the charges 104 are spaced from one another at phased angles thereabout. The one or more shaped charges 104 in each segment 92 can be fired from surface independently of the one or more charges 104 in each of the other segments 92 in the perforating gun assembly 90.

Figure 3C:
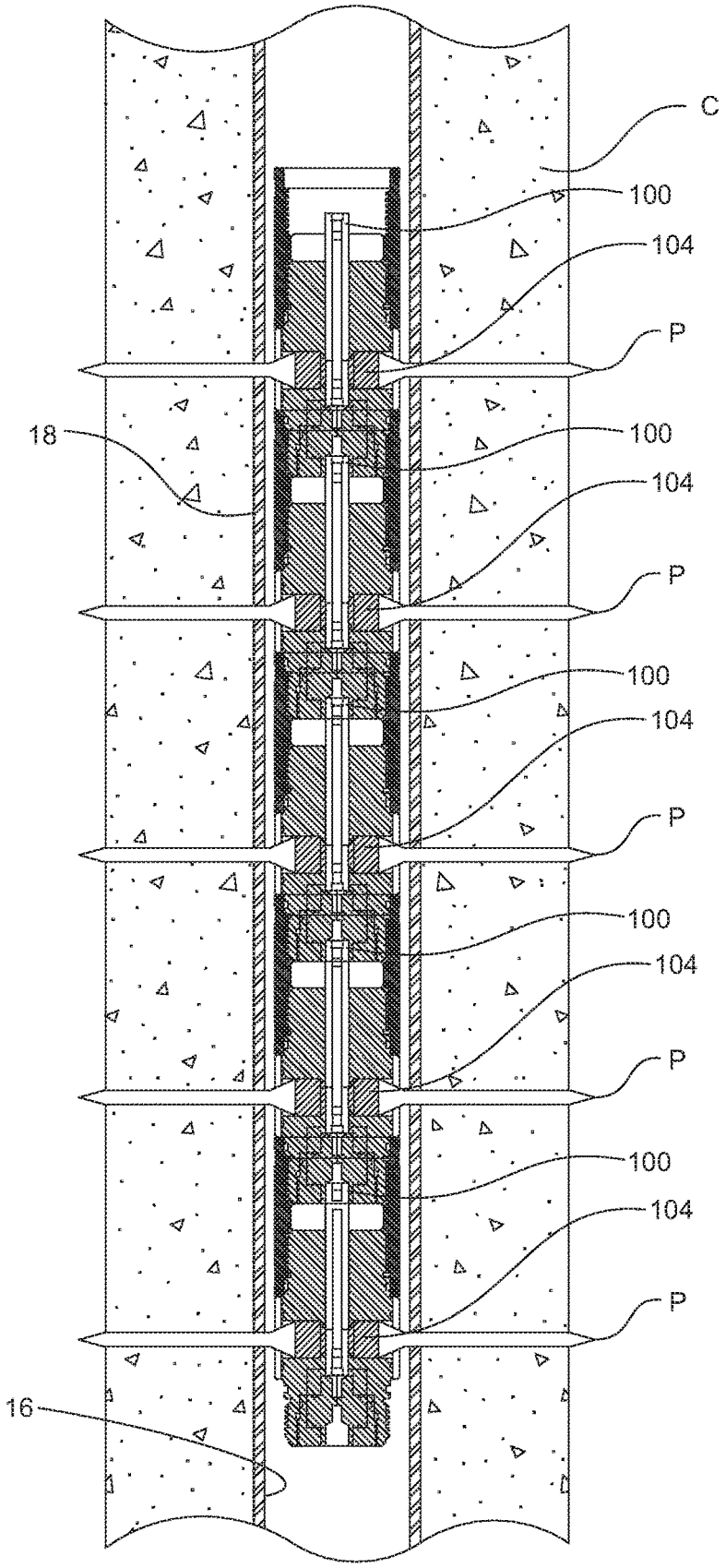
FIG. 3C is an illustration of a plurality of segments forming a portion of an embodiment of a perforating gun assembly positioned in a wellbore, shown without the top sub or connection to the wireline or electrically-enabled for illustrative purposes only, perforations being shown (solid black) to illustrate the effect of detonation of shaped charges therein.
Figure 4:
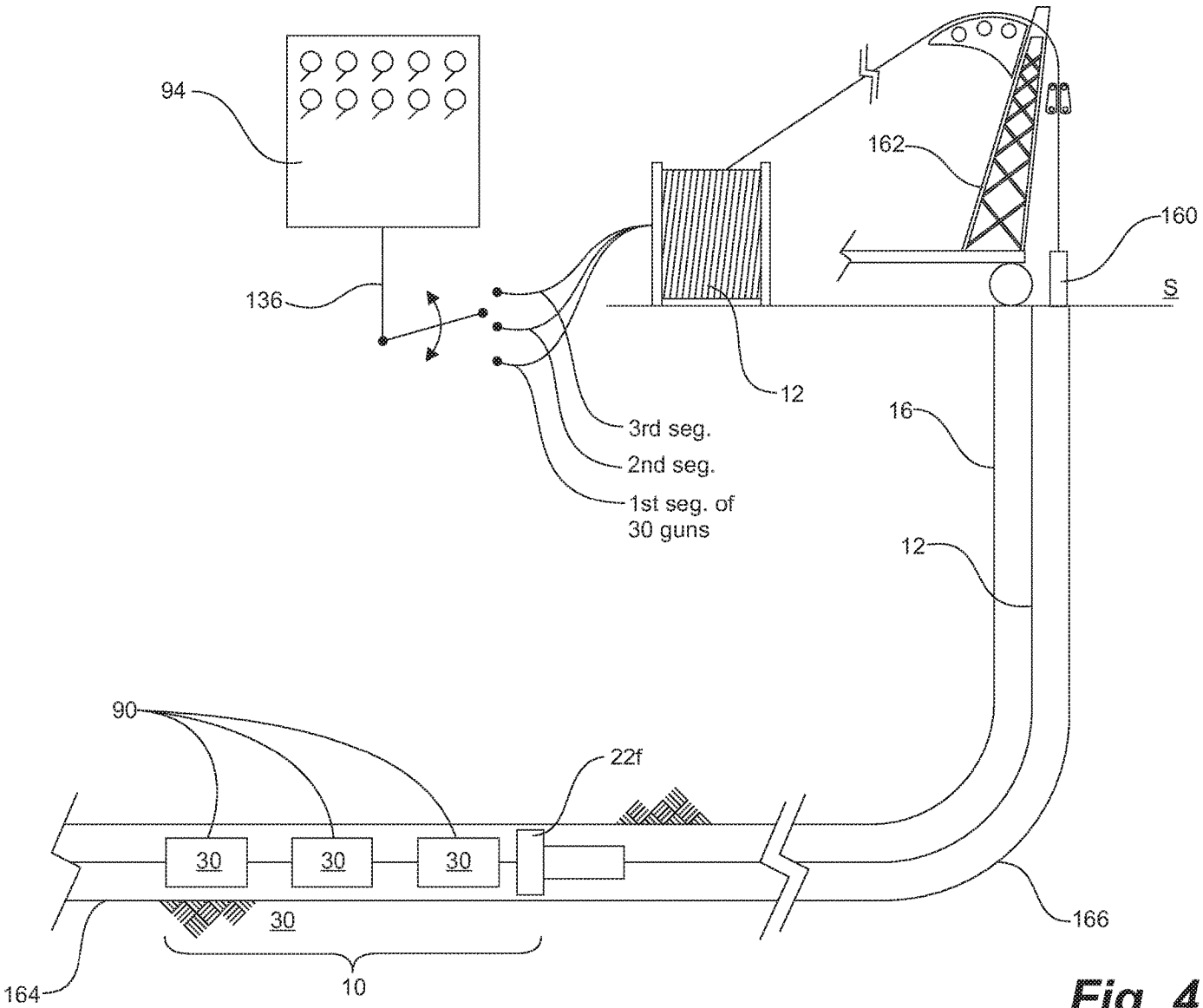
FIG. 4 is a representative illustration of a BHA according to FIG. 1A, deployed in a wellbore using electronically-enabled coiled tubing, a plurality of selectively actuated perforating gun assemblies in the BHA being electronically connected to a firing panel at surface.

In the embodiment shown in FIGS. 3A, 3C and 4, there are thirty cylindrical segments 92, stacked end-to-end, the detonator 100 and switch 102 in each of the 30 segments 92 being electronically connected to the firing panel 94 at surface S. In each of the thirty segments 92, there are three shaped charges 104 which are spaced circumferentially about the segment 92 at about 120° from one another and in proximity to the detonator 100 for actuation of the shaped charges 104. Perforating gun assemblies 90, according to embodiments of the disclosure, are relatively short compared to conventional perforating gun assemblies. In an embodiment, each of the perforation segments 92 is less than about 180 mm in length. A perforating gun assembly 90 having thirty segments 92 is therefore less than about 5.5 m in length.

Figure 3D:
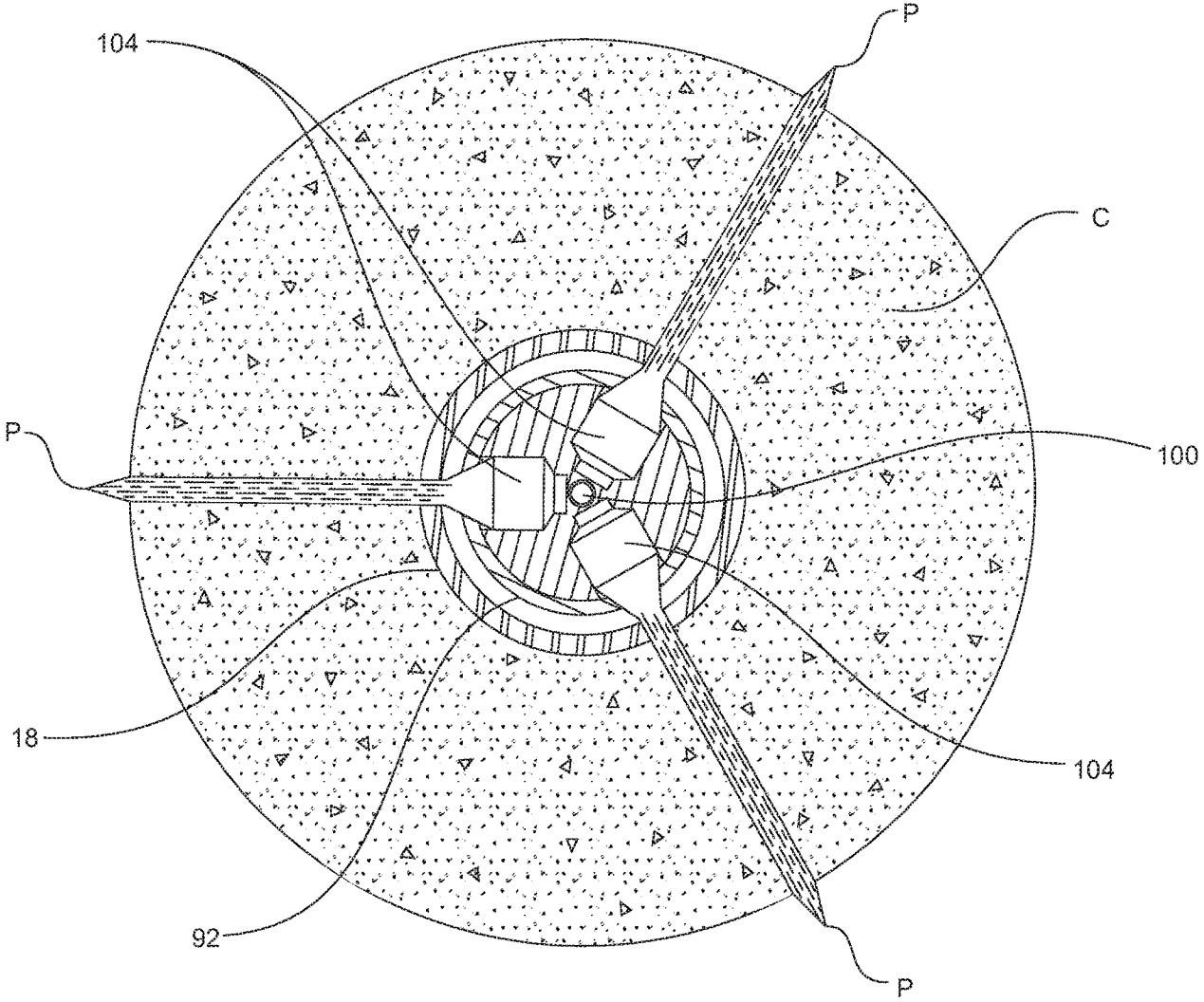
FIG. 3D is a cross-sectional view of a segment of the plurality of segments, according to FIG. 3C.
Figure 3E:
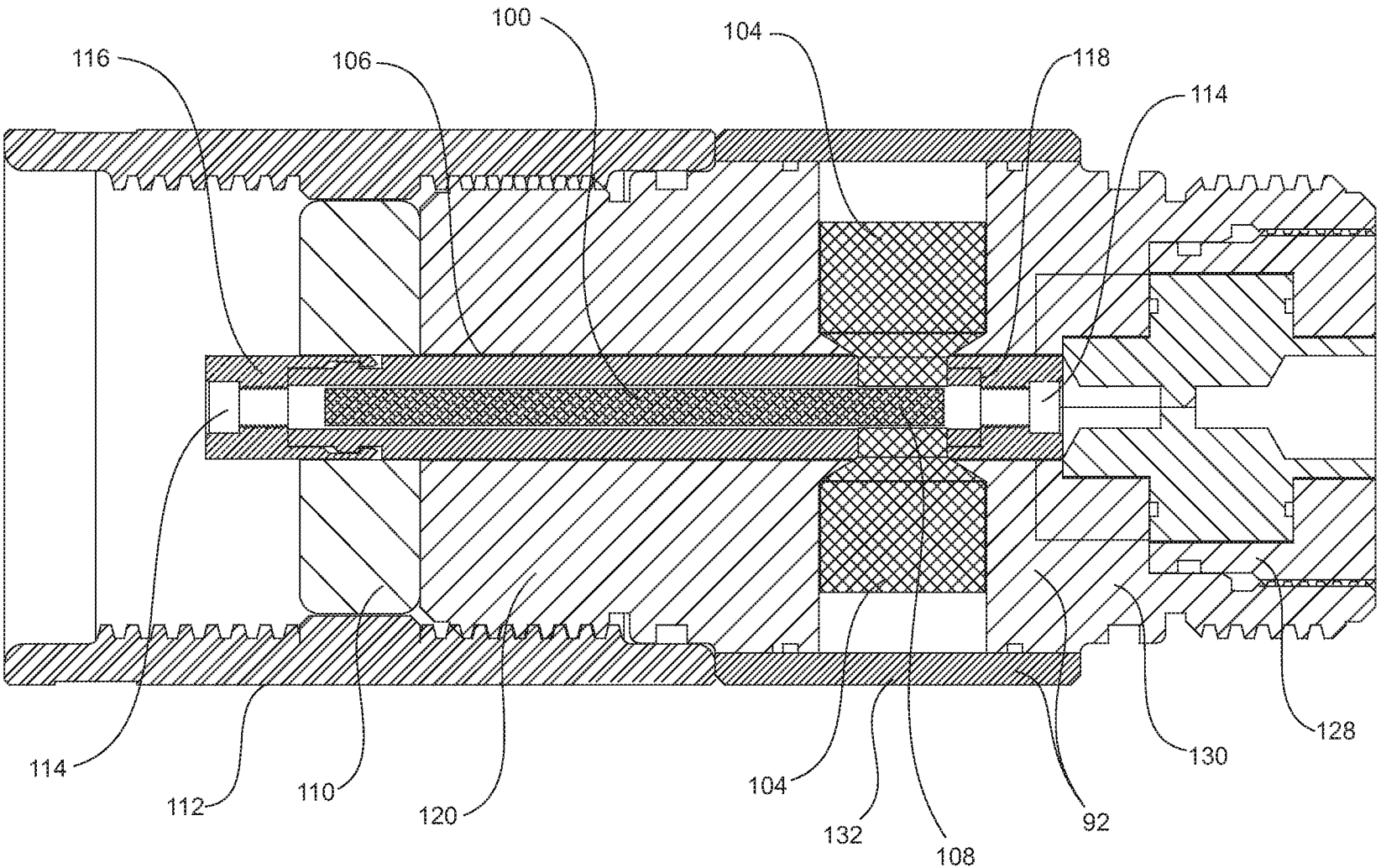
FIG. 3E is a sectional view of a segment of the perforating gun assembly according to FIG. 3C.

As shown in FIGS. 3C to 3E, and in an embodiment, the shaped charges 104 in each segment 92 are operatively connected to the detonator/switch 100,102 by positioning the charges 104 in close proximity to a primer end or blasting cap 108 of the detonator 100 housed in the segment 92. Thus, the perforating gun 90 does not require detonation cord to be run and connected between each of the segments 92 and can be made much shorter than perforating guns which rely on detonation cord to transmit the detonation to shaped charges spaced further away.

Figure 3F:
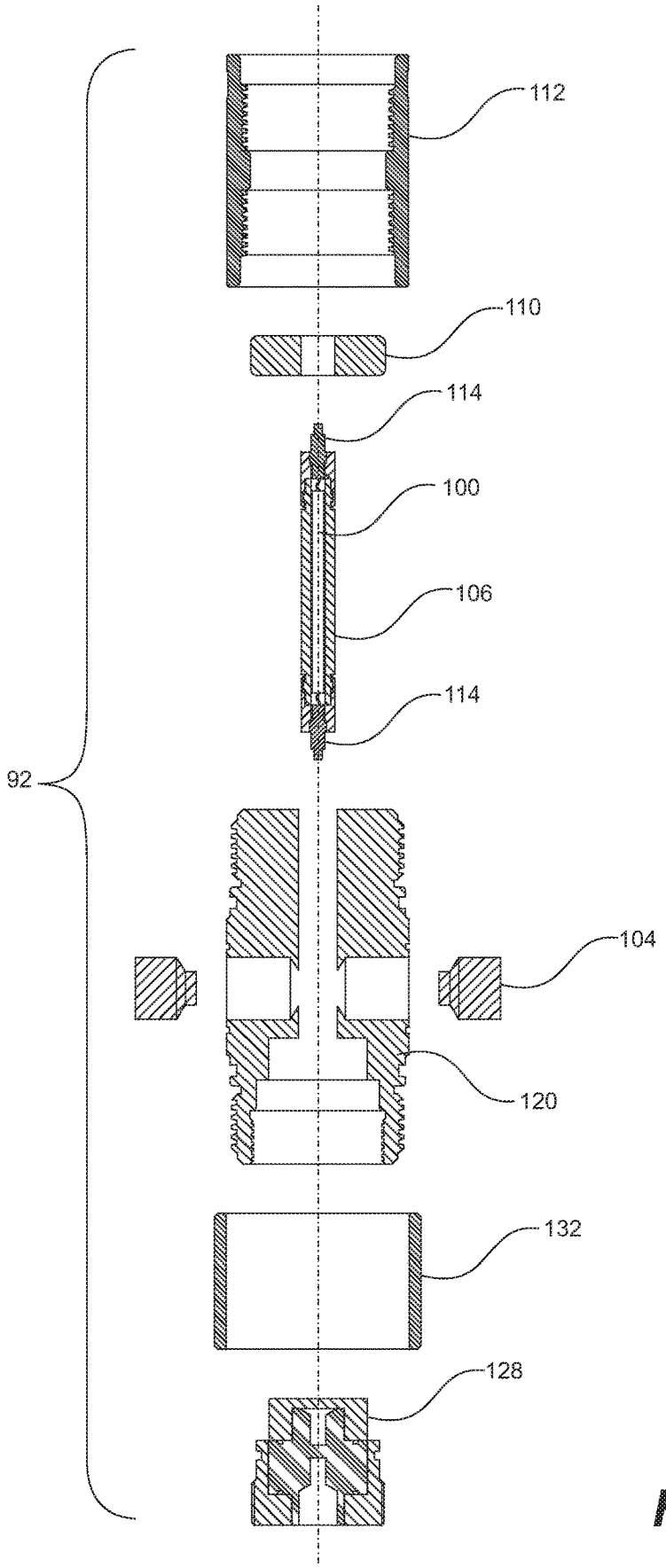
FIG. 3F is an exploded view according to FIG. 3E.

As shown in FIGS. 3E and 3F, the detonator 100 is mounted in the detonator housing 106. The switch (not shown) is built into the detonator housing 106. The detonator housing 106 is supported by a connection ring 110 for insertion into an upper housing 112 of the segment 92. Electrical connections, between the top sub 96 and the switch 102 and detonator 100 can be tested for each segment 92 at this stage of assembly to ensure the connections are viable, without danger of actuating the shaped charges 104. The electrical connections are through conductive pin connections 114 at proximal 116 and distal 118 ends of the detonator housing 106.

Once the electrical connections have been tested and verified, the shaped charges 104 are inserted into a shaped charge retainer 120. The detonator housing 106 passes though a bore 122 in the center of the shaped charge retainer 120 for positioning the charges 104 adjacent the primer end 108 of the detonator 100 therein and is secured therein for co-rotation with the shaped charge retainer 120 as it is threaded into the upper housing 112. In embodiments, the detonator housing 106 has slots formed therein which engage forks on the shaped charges 104 for securing the detonator housing 106 to the shaped charge retainer 120.

A pin connector housing 128 is threaded into a distal end 130 of the shaped charge retainer 120. The pin connector housing 128 can also be threaded to the shaped charge retainer 120 prior to insertion of the shaped charges 104.

Thereafter, a lower tubular housing 132 is positioned over the shaped charges 104 to complete the segment 92 and the upper housing 112 of a subsequent segment 92 is threaded onto the pin connector housing 128, sandwiching the lower tubular housing 132 therebetween. The detonator 100 and detonator housing 106 supported in the subsequent segment 92 extends into the pin connector housing 128 so as to permit an electrical connection between the conductive connection pin 114 on the distal end 118 of the detonator housing 106 in the first segment 92 with the conductive connection pin 114 on the proximal end 116 of the detonator housing 106 in the subsequent segment 92.

Following testing of the electrical connection for the subsequent segment 92, the shaped charges 104 can be loaded therein as described above. Thus, a perforating gun 90 according to this embodiment is lengthened a segment 92 at a time. Each switch 102 built into the detonators 100 is independently triggered by the firing panel 94. Thus, there is little to no danger that a segment 92 having the charges 104 loaded therein can be actuated when the electrical connections are tested in another segment 92 being added.

In embodiments, a single conductor 134 connects all segments 92 in the perforating gun assembly 90 and each segment 92 comprises means for independently triggering shaped charges 104 mounted in each segment 92. The shaped charges 104 are typically detonated from a bottom segment 92 of the gun 90 to a top segment 92 of the gun 90 as the conductor 134 may be damaged by detonation of the shaped charges 104.

The firing panel 94 may be connected to the plurality of segments 92 through the single conductor 134 connected to all of the detonators 100 having switches 102 located at the detonator 100. Alternatively, the firing panel 94 can be connected through multiple conductors 134*n*.

As shown in FIG. 4, perforating gun assemblies 90 having any desired number of segments 92 are possible according to embodiments described herein. Where perforating guns 90 with segments 92 in excess of about twenty to about thirty segments 92 are desired, one or more additional wires can be run from the top sub 96 to one or more tandem subs to which a further about twenty to about thirty or more segments are connected as previously described. In this way, the conductance is optimized throughout all of the segments 92 between the top sub 96 and the tandem sub where tandem subs are used to lengthen the perforating gun 90 and increase the number of segments 92 which can be used in a single run.

For example, each thirty-segment perforating gun assembly, having 3 shaped charges 104 in each segment 92, can create ninety perforations. If multiple, thirty-segment perforating gun assemblies 90 are stacked end-to-end and electrically connected to the firing panel 94, multiples of the ninety perforations can be performed in a single trip. The shaped charges 104 in one segment 92 can be fired at a zone of interest or the shaped charges 104 in more than one segment 92 can be detonated to increase the number of perforations in the zone. The same firing panel 94 used to actuate the switches 102 and detonators 100 of a single, thirty-segment assembly 90 is used to actuate the additional thirty-segment assemblies 90. Once the first thirty segments 92 have been fired, a switch 136 can be flipped at the firing panel 94 to actuate a second or even third set of segments 92 in another of the assemblies 90. In this case, perforation of very long wellbores 16 can be accomplished without having to pull the BHA 10 from the wellbore 16.

The switch 102 and detonator 100 in each segment 92 receives the electronic signal transmitted from the firing panel 94 at surface, through the electrically-enabled CT 12, and responds to actuate detonation of the shaped charges 104 in the selected segment 92 within about 0.5 ms. Time of firing is therefore known within about 0.5 ms.

By way of example only, detonators 100, switches 102 and firing panel 94 systems, suitable for use in embodiments described herein, are available from DYNAenergetics GmbH & CO. KG, Laatzen, Germany.

The exact time of firing of the perforating gun 90 as described above can be particularly advantageous when the wellbore 16 is to be fractured following perforation and if a microseismic fracture monitoring system is in place to monitor the growth and placement of the fractures. The firing of the perforating guns 90 creates noise events in the wellbore 16 to be fractured which can be used, in combination with the accurate timing of detonation, to improve development of velocity profiles, sensor orientation and sensor calibration used in the microseismic monitoring.

Microseismic sensors 140, positioned at least at surface, such as in an array, and/or the sensors 140 incorporated in the BHA 10, are able to detect the noise events resulting from the detonation of the shaped charges 104 or the perforation of the casing 18. The data, in combination with the accurate time of initiation of the noise events, is particularly useful in calculating a velocity profile for the formation to be fractured.

Generally, the shaped charges 104 in each segment 92 are detonated at different locations in the wellbore 16. The firing panel 94 at surface is used for firing the shaped charges 104 in each of the perforating gun segments, as desired. For example, the shaped charges 104 in a first distal perforating gun segment 92 are fired when the perforating gun 90 is located at a first location in the wellbore 16, such as adjacent a toe of the wellbore 16. Thereafter, the perforating gun 90 is repositioned to a second location in the wellbore 16 and the shaped charges 104 in a second of the segments 92 are fired. The repositioning and firing of the shaped charges 104 is repeated for the remaining segments as the perforating gun 90 is relocated toward the heel or uphole within the wellbore 16.

Embodiments disclosed herein further comprise fluid isolation between segments 92 of the perforating gun 90 such that when the shaped charges 104 are detonated, fracturing fluid F and the like cannot flow between segments 92. As shown in FIG. 3E, the pin connection housing 128 provides fluid isolation between the adjacent segments 92.

In embodiments where the perforating apparatus 84 is an electrically-actuated punch tool or electrically-actuated drilling assembly or the like, the tool can be electrically-actuated from surface to form any number of perforations in the casing in each zone of interest. In this embodiment, the number of perforations which can be made is not limited by the perforating apparatus 84 as is the case in the perforating gun 90 which has a fixed number of shaped charges 104 therein.

New Wellbores

Single packer embodiments as described herein are particularly suitable for use in new wellbores. New wellbores 16 are drilled, but have not yet been completed. Further, new wellbores 16 can be cased 18 and which have ported sliding sleeve subs 24 installed therein, sliding sleeves 26 therein having not yet been actuated for opening ports 28 in the ported subs 24 to access formation 30 therebeyond. In embodiments, the sliding sleeves 26 may also be selectively closable to stop communication between the formation 30 and a bore 32 of the casing 18 therethrough.

In Use in New Cased or Lined Wellbores

In use, as shown in FIGS. 2A-2C, 4, and 5A-5C, the BHA 10 is connected to the electrically-enabled CT 12 and is injected into the wellbore 16 through a lubricator 160. As the BHA 10 is relatively compact, the lubricator 160 has a height which is much shorter than required for a conventional single-trip BHA. In embodiments, the lubricator 160 is about 12 m compared to 20 m to 30 m and greater required for a conventional BHA. Further, surface equipment 162, such as cranes, can be used to raise embodiments of the BHA 10 compared to equipment required to raise and inject longer conventional BHA's.

Once run into the wellbore 16, as shown in FIG. 2A, the packer element 66 of the first packer 22*f* is electronically actuated to expand to the running diameter. Fluid F is pumped into the annulus 34 formed between the electrically-enabled CT-deployed BHA 10 and the wellbore wall 36 or casing 18 for acting at the uphole piston face 64 of the expanded packer element 66 for pumping the first packer 22*f* and the BHA 10 connected thereto into the wellbore 16, such as to a toe 164 of the wellbore 16 (FIG. 4). The electrically-enabled CT 12 is pulled downhole with the first packer 22*f* and the BHA 10. Typically the BHA 10 is run into the toe 64 as fracturing is performed at intervals or zones of interest from the toe 164 of the wellbore toward a heel 166 of the wellbore 16.

Figures 5A, 5B, 5C:
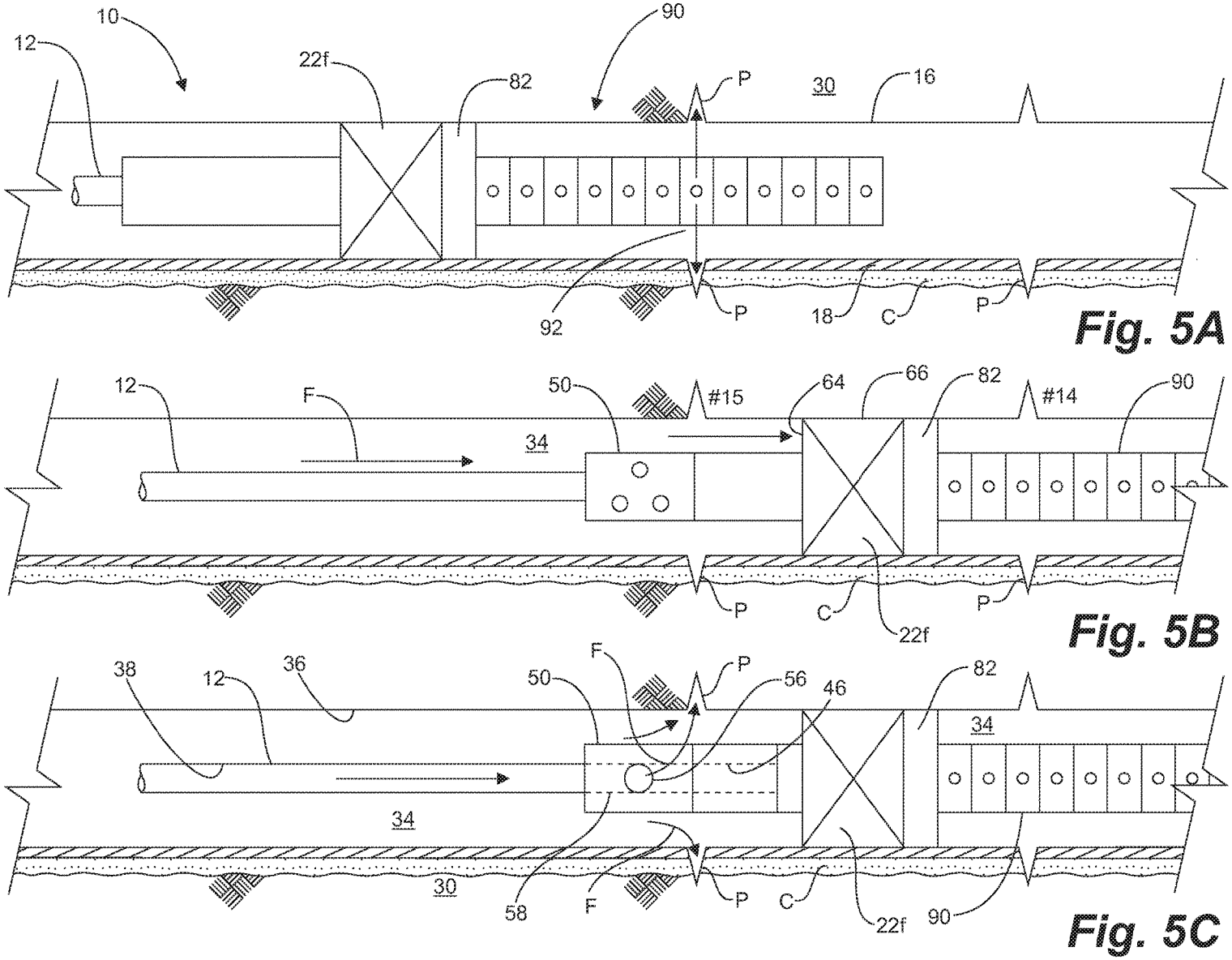
FIGS. 5A-5D are representative illustrations of use of an embodiment of the BHA according to FIG. 1A for perforating and fracturing a formation according to embodiments of the disclosure, more particularly

As shown in FIG. 5A, when the BHA 10 is accurately positioned, using the CCL 82, the perforating gun 90 is adjacent a non-perforated zone of interest in the formation 30. A select detonator 100 and switch 102 in a segment 92 of the selectively actuated perforating gun 90 is electronically-actuated from the firing panel 94 at surface S for perforating the wellbore 16 or casing 18, if cased. Where the wellbore 16 is cased and the casing 18 is cemented into place, the cement C may also be perforated by the explosion of the shaped charges 104. Alternatively, one may simply pump fracturing fluid F, at fracturing pressures, through the perforations in the casing 18, to fracture the cement and access the formation, as is understood in the art.

Thereafter, a shown in FIG. 5B, the BHA 10 is repositioned such that the first packer 22*f* is positioned below the latest or most recently formed perforations and above any previous perforations. The packer element 66 of the first packer 22*f* is electrically-actuated to expand to the sealing diameter to seal the first packer 22*f* against the wellbore 16 or casing 18 and isolate the annulus 34 therebelow.

As shown in FIG. 5C, the valve 50 is electrically-actuated to the first position to flow treatment fluid F, at fracturing pressures, from the CT 12 through the throughbore 54 to exit the fracturing ports 56 to the annulus 34 above the first packer 22*f* for delivery through the latest perforations P to the formation 30 therebeyond.

Figure 5D:
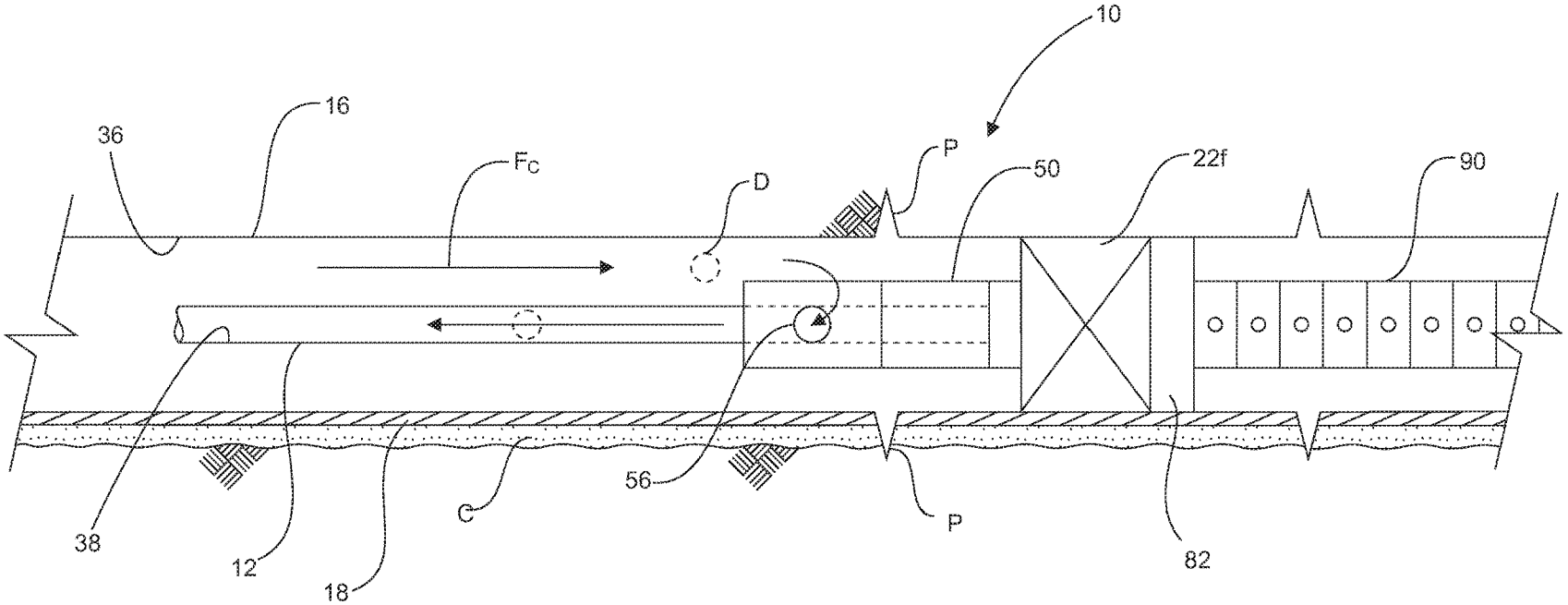

Having reference to FIG. 5D, when the zone of interest has been fractured, the valve 50 can either be shut off to stop the flow of fluid F through the bore 46 of the BHA 10 or maintained open to permit reverse circulation of debris D from the annulus 34 to surface S through the bore 38 of the electrically-enabled CT 12 by flowing a clean fluid Fc down the annulus 34. Alternatively, clean fluid Fc can be circulated down the bore 38 of the electrically-enabled CT 12 with reverse circulation of debris D to surface S through the annulus 34. The ability to open and flush the first packer 22*f* permits the operator to run with a higher sand density, even risking sand off because of the ease with which one can recover. One can fully retract the first packer 22*f* and circulate the sand out of the well.

When a fracture is complete, one can use CT strain sensors to determine whether downhole conditions have changed, such as due to temperature effects resulting in residual set-down or pull-up on the first packer 22*f*. CT set-down or pull-up load can be adjusted accordingly to protect the packer 22*f*.

The first packer 22*f* is thereafter released from the wellbore 16 by electronically-actuating the packer element 66 to reduce to the running diameter to unseal from the wellbore (FIG. 2A) and permit relocation of the BHA 10 through the wellbore. Release of the packer 22*f* can also include actuation of an equalization valve to equalize the pressure across the packer 22*f* before or at the same time as the packer 22*f* is released.

Figure 6:
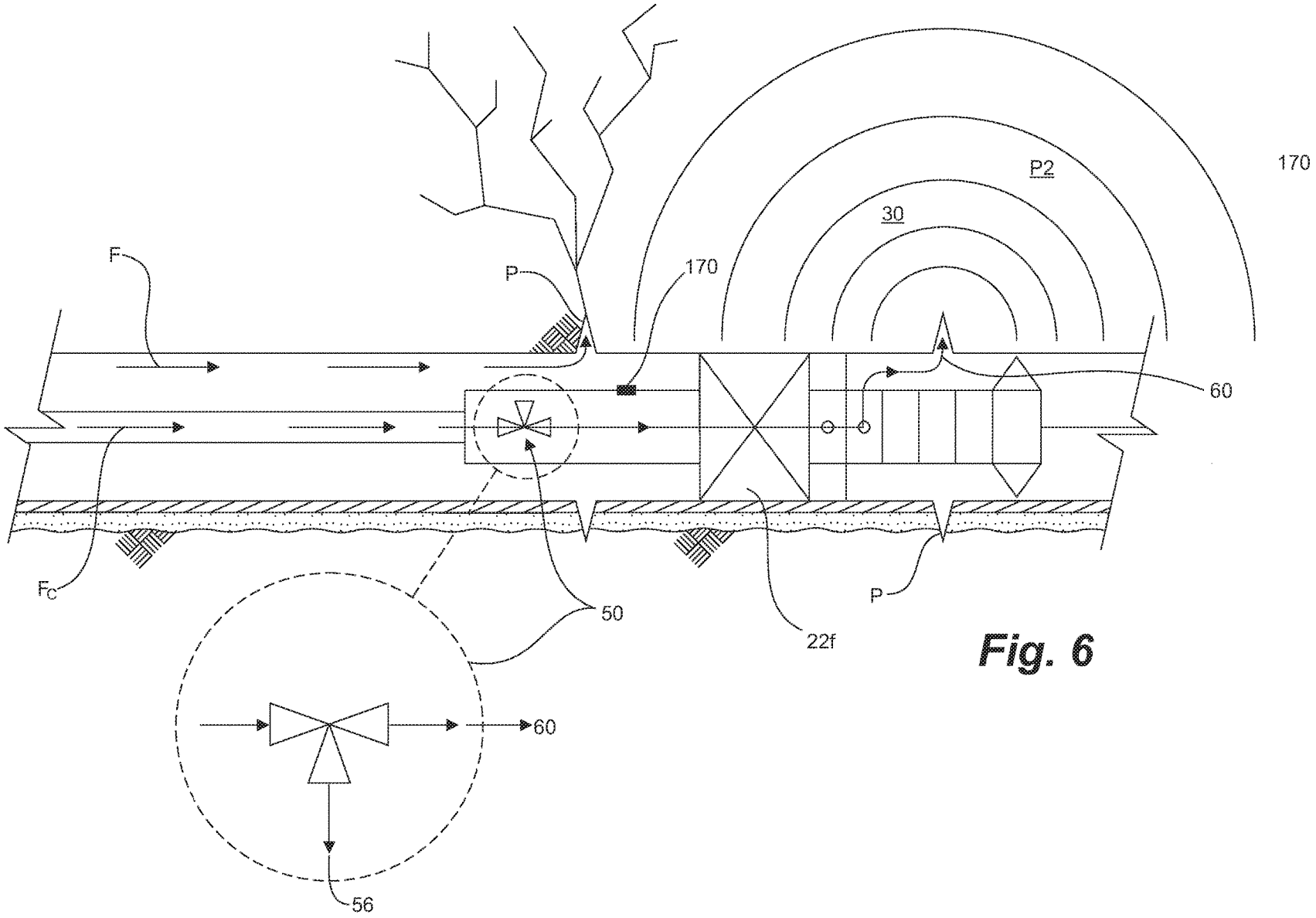
FIG. 6 is a diagrammatic representation of a process for minimizing decrease in rock stress about a previously fractured zone during fracturing of an adjacent zone, fracturing fluid being delivered to the annulus above the packer at pressure P1 and fluid being delivered through the coiled tubing to the annulus below the packer at P2, P2 being greater than P1 for pressuring the formation about the previous fracture.

Electric motors in the first packer drive sub 70*f* actuated to reduce the diameter of the first packer 22*f*, turn a shaft which, in turn, moves a mandrel having a valve thereon which opens prior to release of the packer element 66 to release pressure above and below the first packer 22*f*. Having reference to FIGS. 1B and 6, as pressure can be monitored above and below the first packer 22*f*, using pressure sensors 170 positioned for monitoring the pressure P1 in the annulus 34 above the first packer 22*f* and the pressure P2 in the annulus 34 below the first packer 22*f*. one can monitor the pressures P1,P2 until equalized prior to unseating the first packer 22*f* and moving the BHA 10.

The BHA 10 is then lifted using the electrically-enabled CT 12 to position the perforating gun 90 adjacent the next zone of interest, uphole from the previously perforated and completed zone. Once again, a segment 92 of the perforating gun 90 is electronically actuated using the firing panel 94 at surface S and the shaped charges 104 in another of the segments 94 are detonated. Fluid F is pumped against the piston face 64 of the first packer 22*f* for moving the BHA 10 downhole for positioning the first packer 22*f* below the newly created perforations P in the uncompleted zone. Once in position, the packer element 66 is electronically actuated from surface S to expand to the sealing diameter to seal against the wellbore wall 36 or casing 16 and the fracturing operation is repeated, as described above.

In conventional completion operations, a "dead leg" is used not only to prevent collapse of the CT 12 under pressure from fluids in the annulus 34, but also to permit calculation of pressure to determine reaction of the formation 30 to the fracturing operation.

In embodiments described herein, and having reference again to FIGS. 1B and 6, the downhole electronic capabilities provided by the electrically-enabled CT 12 and connections within the BHA 10 permit direct measurement of parameters such as pressure, temperature, vibration and the like. Pressure sensors 170 are positioned for monitoring the pressure P2 in the annulus 34 below the first packer 22*f*. The pressure sensors 170 are electrically connected to the electronics sub 80 for transmission of data to surface S via the electrically-enabled CT 12. While a pressure P1, above the first packer 22*f*, can be calculated at surface S, the electronics sub 80 can also be electrically connected to pressure sensors 170 which directly monitor the pressure P1 in the annulus 34 above the first packer 22*f*. As will be appreciated by those of skill in the art, pressure P1 above the first packer 22*f* is indicative of how the formation 30 is reacting to the fracturing operation while pressure P2 below the first packer 22*f* may be indicative of the integrity of the packer element 66 of the first packer 22*f* and the formation 30 between adjacent zones. Further, after stopping pumping of the fracture fluid F, fracture closure pressures can also be monitored.

The ability to measure pressures may be particularly advantageous when high rate foam fracturing is performed as measuring pressure enables understanding of the quality of the foam at the perforations.

Cased Wellbores with Sliding Sleeves

As shown in FIG. 1A, it is known to incorporate a plurality of the ported sliding sleeve subs 24 into the casing 16 or in a liner in a wellbore 16. The sliding sleeves 26 are opened for opening the pre-existing ports 28 in the casing 18, minimizing the need to perforate the casing 18 for accessing the formation 30 therebeyond. In some cases, the opened sliding sleeves 26 can also be actuated to close for isolating portions of the formation 30 from fluids flowing through the casing 18.

In embodiments, as taught in Applicant's co-pending U.S. application Ser. No. 13/773,455, the entirety of which is incorporated herein, the BHA 10 further comprises a CCL 82 which can be mechanical or electronic and which detects collars between joints of casing 18, rather than a bottom of the sliding sleeve 26, as in the prior art. Thus, the CCL 82 is used to locate the BHA 10 based on a location of the casing 18 or locating collar adjacent and downhole of the ported sliding sleeve sub 24. Accordingly, the length of the ported sub 24 and sleeves 26 do not need to be a function of BHA length and therefore not as long as the prior art. The CCL 82 does not need to be a specialized CCL for detecting a profile at the lower end of the prior art ported sub and sliding sleeve therein.

In embodiments, the CCL 82 is spaced below the first packer 22*f*, such as by a length of relatively inexpensive pup joint, positioning the CCL 82, when engaged, to appropriately position the fracturing ports 56 at or near the pre-existing ports 28 in the ported sub 24 when the CCL 82 engages the locating collar 19. In embodiments, the downhole end of the ported sub 24, the locating collar 19 or lengths of adjacent casing 18 are aggressively profiled to assist detection by the CCL 82.

In embodiments, when the CCL 82 locates the BHA 10 for positioning the fracturing ports 56 adjacent the open ports 28 in the ported sub 24, the first packer 22*f* is located below the open ports 28. The first packer 22*f*, when electrically-actuated to the sealing diameter, acts to isolate the annulus 34 therebelow from fracturing fluids F which can be delivered to the fracturing ports 56 in the BHA 10 either through the electrically-enabled CT 12 for delivery to the open ports 28 in the casing 18, directly to the open ports 28 in the casing 18 through the annulus 34 above the first packer 22*f*, or through both.

In embodiments where the CCL 82 is an electronically-actuated CCL, detection of an end of the ported sleeve sub 24 can be accurate within millimeters. The accuracy of detection of the location of the sleeve sub 24 further permits the ported sleeve sub 24 to be much shorter than a conventional sleeve sub. The reduction in length significantly reduces the cost of the sleeve subs 24 and the BHA 10. In embodiments, both the sleeve sub 24 and the BHA 10 are reduced in length to about one-half or less that of a conventional sleeve sub and BHA. In embodiments, the BHA 10, excluding the length of the perforating apparatus 84, is about 4 m to about 5 m.

Sleeves 26 can be opened using a variety of conventional sleeve opening and closing techniques, including but not limited to setting the first packer 22*f* within the sleeve 26, expanding the packer element 66 and thereafter utilizing fluid F to force the first packer 22*f* and sleeve 26 to shift the sleeve 26 axially therein, electronically or mechanically actuating a shifting tool (not shown) incorporated in the BHA 10 to engage the sleeve 26 and shift the sleeve 26 axially therein or by actuating a rotational opening tool to engage the sleeve 26 for rotation to an open position. Alternatively, differential pressure can be used to hydraulically open the sleeve 26.

In embodiments, where there has been a failure of the sliding sleeve 26 to open, the selectively actuated perforating gun assembly 90 can be used to perforate the ported sub 24. Further, the perforating gun assembly 90 can be used to create perforations in the casing 18 at zones of interest where there are no sliding sleeve subs 24.

In Use—Cased Wellbores with Ported Sleeve Subs

Once the sleeve 26 has been moved to open the ports 28 in the ported sleeve sub 24 or perforations P have been made through the casing 18 or ported sub 24, where sleeves 26 did not exist or failed to open, treatment therethrough proceeds as previously described above.

In embodiments, following treatment, the ports 28 in the ported sleeve subs 24 are closed, as is understood by those of skill in the art.

Multiple Packer Embodiments

Figure 7:
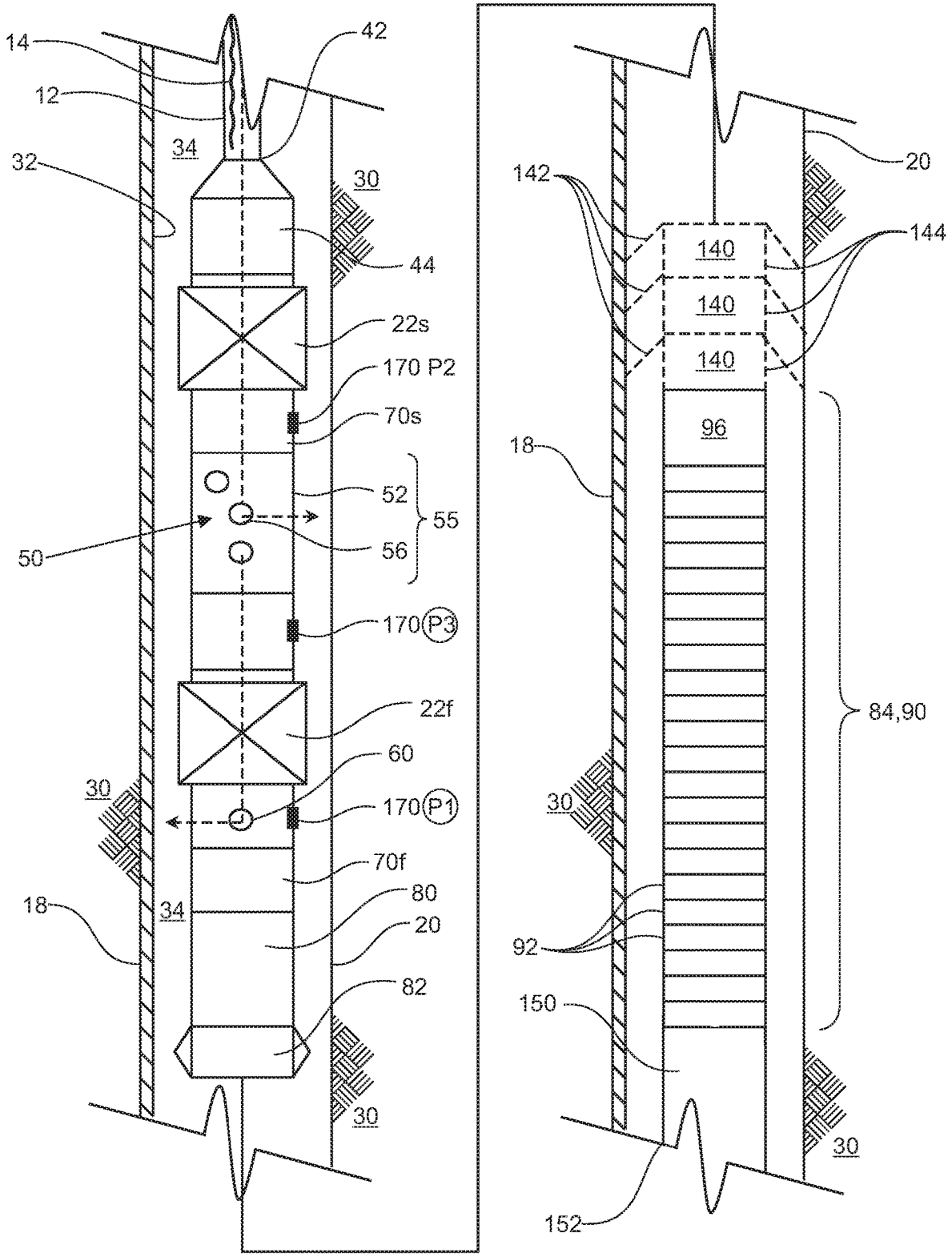
FIG. 7 is a representative illustration of a bottomhole assembly BHA according to FIG. 1A having two, spaced-apart, variable diameter packers incorporated therein, a first packer being below the fracturing ports and valve, and a second packer being above the fracturing ports and valve.

In embodiments, having reference to FIG. 7, the BHA 10 further comprises at least the second, variable diameter packer 22*s*, spaced uphole from the first variable diameter packer 22*f* and the valve 50. Embodiments having two packers 22*f*,22*s* are particularly suitable for use in previously perforated wellbores, newly perforated wells having all of the zones perforated therein, wellbores having sleeves 26 which are in the open position or in openhole wellbores 20.

The first and second variable diameter packers 22*f*,22*s* straddle the fracturing ports 56. In embodiments, a second packer drive sub 70*s* positioned below the second packer 22*s* is electronically actuated to vary the diameter of the packer element 66 in the second packer 22*s*. Optionally, the first packer drive sub 70*f* may be electrically connected to both the first and second variable diameter packers 22*f*,22*s* and is capable of independently electronically actuating packers elements 66 in both the first and second packers 22*f*, 22*s*. In either case, the packer elements 66 of the first and second packers 22*f*, 22*s* are independently variable with respect to diameter.

New Wellbores

While a separate BHA 10 having the first and second packers 22*f*, 22*s* can be used for previously perforated or openhole wellbores, due to the independent controllability of the variable diameter packers 22, the same BHA 10 used for the previously perforated wellbores 16 is also used for new wellbores 16. The second packer 22*s* may simply not be used during the fracturing operation. In this case, the second packer 22*s* may be used to assist in moving the BHA 10 within the wellbore by increasing the diameter of the packer elements to the running diameter but it is thereafter reduced to the minimum packer diameter once the BHA 10 is positioned with the first packer 22*f* below the perforations P or opened sleeve 26. Thus, during the subsequent fracturing operation treatment fluids F can be delivered through the annulus 34 to the perforations P, as well as through the bore 38 of the electrically-enabled CT 12.

Use of one tool suitable for new or old wells reduces inventory and improves standardization.

Perforated Wellbores

Previously perforated or newly perforated wellbores 16 are wellbores 16 that have had perforations P made in the casing or liner 18 for production of formation fluids therethrough. During the life of the previously perforated wellbore 16, there may be a need to stimulate production from the formation 30 or otherwise treat the formation 30, such as by fracturing. As the existing perforations P whether newly made or existing, wherever they occur along a length of the wellbore 16, provide fluid connections to the formation 30, select perforations P at a zone of interest must be isolated from the remaining perforations P for treatment of only the zone of interest.

Cased Wellbores with Open Sliding Sleeves

Previously perforated wellbores 16 may also be wellbores 16 having ported sleeve subs 24 incorporated therein which have been previously opened by shifting or rotating sleeves 26 which thereafter have not or cannot be closed.

In Use in Cased, Perforated Wellbores or in Openhole Wellbores

The BHA 10 is lowered into the wellbore 16 until the perforations P at the zone of interest are located between the first and second variable diameter packers 22*f*,22*s*. One can use a CCL to position the BHA 10 as described above. Once in position, the first and second packers 22*s*,22*f* are independently electrically-actuated to expand the packer element 66 to the sealing diameter, straddling the perforations P therebetween. Fracturing fluid F is delivered through the electrically-enabled CT 12 and exits the fracturing ports 56 to the formation 30 isolated between the first and second packers 22*f*, 22*s* or through the perforations P to the formation 30 therebeyond.

Perforation Option

Where a zone of interest has not been previously perforated, the diameter of the packer element 66 of at least the second variable diameter packer 22*s* is expanded to the running diameter for pumping the BHA 10 downhole. The first packer 22*f*, below the valve 50 and fracturing ports 56 can be at a smaller diameter than the second packer 22*s* or can also be at the running diameter during pumping downhole. The BHA 10 is pumped downhole as described above to position the perforating apparatus 84, such as the perforating gun assembly 90, adjacent the non-perforated zone of interest and a segment 92 of the perforating gun assembly 90 is actuated electronically from surface to perforate the casing or liner 18.

Thereafter, the BHA 10 is pumped further downhole to position the newly formed perforations P between the first and second packers 22*f*,22*s*. The packers 22*f*,22*s* are thereafter independently electronically-actuated to the sealing diameter on either side of the newly formed perforations P and the fracturing operation is performed, as previously described.

In embodiments having the first and second variable diameter packers 22*f*,22*s*, the electronics sub 80 further comprises electronics connected to additional pressure sensors 170 for monitoring the fracturing pressure P3 between the first and second packers 22*f*,22*s*.

Figure 8A:
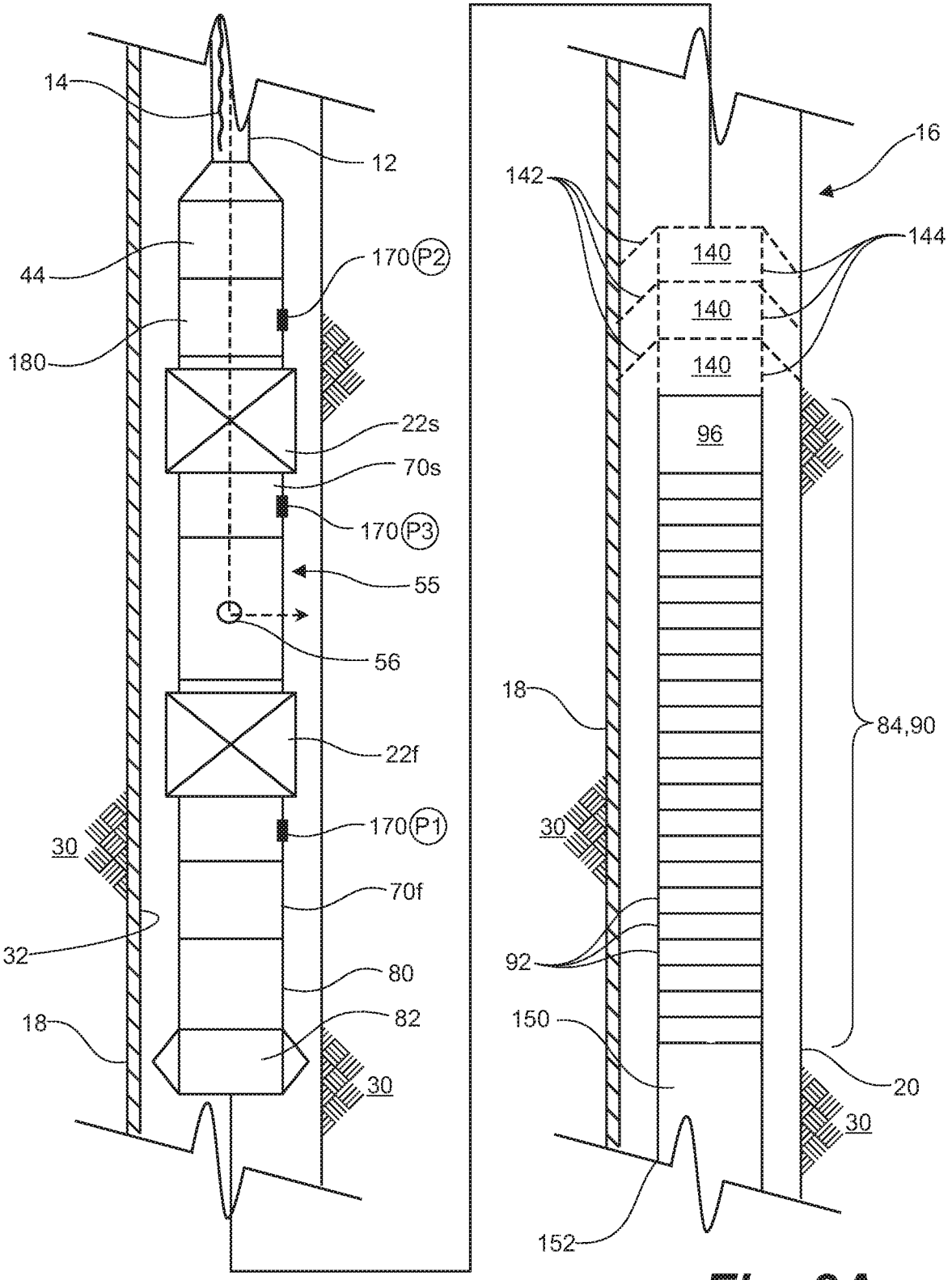
FIG. 8A is a representative illustration of a bottomhole assembly BHA according FIG. 7 and having fracturing ports between the two spaced apart packers instead of a valve.

In an embodiment, as shown in FIG. 8A, in contrast to the embodiment shown in FIGS. 1A, 1B and 7, the fracturing head 55 may not require a valve between the first and second variable diameter packers 22*f*,22*s*. Fracturing ports 56 can be in constant fluid communication with the bore 38 of the electrically-enabled CT 12 for delivery of treatment fluid F therethrough to the fracturing ports 56 to the annulus 34 and to the formation 30 through the perforations P. Optionally, embodiments may comprise a safety valve 180, such as a ¼ turn electrically-actuated valve or manual check valve, positioned between the disconnect 44 and the second packer 22*s*. Should there be a disconnect to leave the tool downhole, the safety valve could be used to prevent flow uphole through the CT 12.

Openhole Wellbores

In the case of openhole completions, as there are no casing collars to locate using the CCL 82, the BHA 10 is positioned in the wellbore 16 using depth control means such as a logging tool or a depth measurement tool at surface which measures the length of CT 12 deployed. The first and second packers 22*f*,22*s* are positioned adjacent the zone of interest and the packing elements 66 are expanded to the sealing diameter for sealing against the uncased and unlined wall 36 of the wellbore 16.

Pressure Equalization—Single and Multi-Packer Embodiments

Figure 8B:
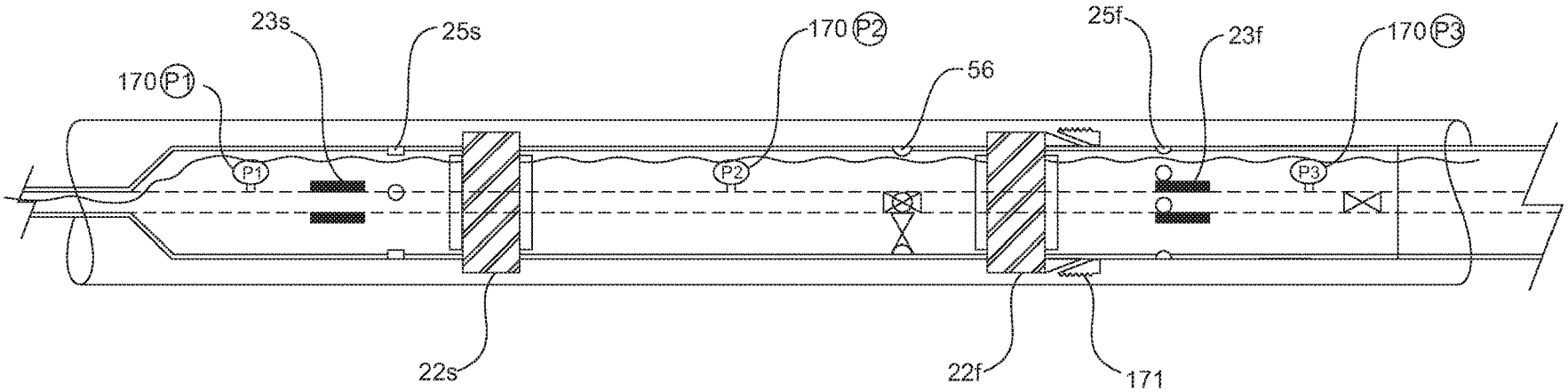
FIG. 8B is a representative illustration of a bottom hole assembly according to an embodiment having equalization valves associated with first and second packers actuable for pressure equalization across the first and second packers before moving the BHA in the wellbore.

With reference to FIG. 8B, another embodiment of a two packer arrangement is provided, illustrated in cased wellbore, in which both the first, downhole packer 22*f* is electrically actuable and the second, uphole packer 22*s* is also electrically actuable. The first packer 22*f* includes slips 171 for securing the BHA in the wellbore. The first packer 22*f* is associated with a bypass or equalization valve 23*f* for releasing differential pressure across the packer 22*f* before releasing. Equalization ports 25*f* fluidly communication between the CT bore 38 and the annulus 34. The equalization valve 23*f* operates the ports 25*f* between open and closed positions and is actuated by the first packer drive sub 70*f*, first opening the valve 23*f* and then releasing the packer 22*f*.

Similarly, the second packer 22*s* is associated with a bypass or equalization valve 23*s* for releasing differential pressure across the second packer 22*s* before releasing. Equalization ports 25*s* fluidly communication between the CT bore 38 and the annulus 34. The equalization valve 23*s* operates the ports 25*s* between open and closed positions and is actuated by the second packer drive sub 70*s*, first opening the valve 23*s* and then releasing the packer 22*s*.

In one embodiment, to move the BHA 10, one would release the uphole, second packer 22*s*, by first equalizing pressure across the packer, electrically-actuating the second packer 22*s* to release from the sealing diameter to the running diameter or the minimum diameter. As stated above, one can monitor the pressure above and below the second packer 22*s* and above and below the first packer 22*f* using pressure sensors 170 (P1,P2 and P3). Thereafter, one prepares to release the downhole, first packer 22*f*, by equalizing pressure across the first packer 22*f* and checking for undue stain in the BHA above the first packer 22*f*. CT set-down or pull-up load can be adjusted accordingly to protect the packer 22*f*. The CT can be injected or pulled to neutralize residual axial forces on the BHA before releasing the slips. If the slips 171 are released before neutralizing the strain, the packer 22*f*,22*s* could be damaged. Once strain has been neutralized, the first packer 22*f* is the electrically-actuated to release from the sealing diameter to the running diameter or the minimum diameter. The BHA 10 can be moved to another position or pulled out of hole.

As discussed, the variable electrically-actuated packer is usable as a pump-down piston configuration, however as the pumping forces can be very large and the rate of the injection is determined separately, there is the risk of over-run injecting and backing up of the CT 12 in the wellbore 16, or an under-running of the injector resulting in large tensile forces in the CT 12. A failure of the BHA 10 and CT 12 is possible, resulting in loss of the BHA 10.

While the BHA 10 is secured in both the cased or openhole wellbore 16 as a result of pressure balancing across the two packers 22*f*, 22*s*, slips 171 can also be set in at least the first packer 22*f* for securing the BHA 10 in the wellbore 16.

Mechanical Release—Single and Multi-Packer Embodiments

As one of skill will appreciate, the BHA 10 further comprises mechanical release mechanisms, such as shear pins or pressure-actuated dogs and the like as are understood in the art, for releasing the first and second packers 22*f*,22*s* from the wellbore 16 in the event that the BHA 10 becomes stuck in the wellbore 16. Use of such release mechanisms avoids the need to disconnect the BHA 10 unless absolutely necessary.

Microseismic Monitoring—Single and Multi-Packer Embodiments

In embodiments disclosed herein and as described in Applicant's U.S. provisional application 61/774,486, incorporated herein by reference, using at least one sensor 140, such as a geophone, accelerometer or the like, integrated into the BHA 10, the at least one sensor 140, typically a 3-component sensor, detects compressional waves (P) and shear waves (S) from microseismic events in the wellbore and outside the wellbore. However, one cannot easily separate signals from the event of interest from signals derived from noise occurring as a result of apparatus used for pumping the fracture and other inherent noise events.

Figure 9:
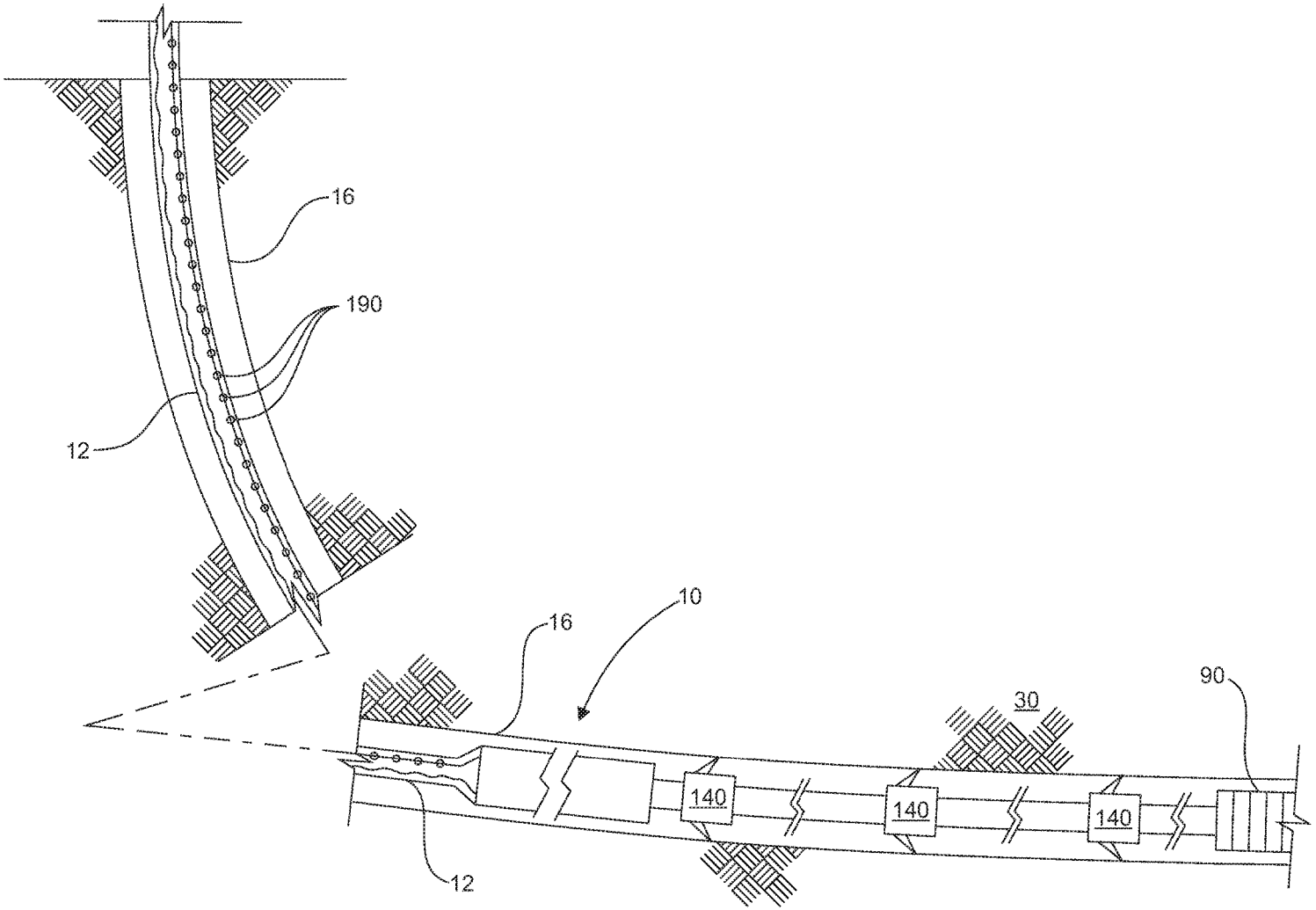
FIG. 9 is a representative illustration of a BHA according to an embodiment having microseismic sensors incorporated therein and in combination with a linear array of fiber optic sensors deployed along at least a portion of a horizontal wellbore.

As shown in FIG. 9, fiber optic distributed sensors 190, such as those in one or more optical fibers deployed in the wellbore 16 and which span a length of the wellbore, are capable of detecting P-waves, but do not typically detect S-waves. The one or more optical fibers or linear array of fiber optic sensors 190 are capable of detecting energy originating from within the formation 30 adjacent the wellbore 16. The detected energy can be used only to estimate distance away from the linear array 190 at which the energy originated, but not the direction and thus is not particularly useful in positioning the event in the formation 30.

Applicant believes that the combination of the ability to obtain both P-wave and S-wave data, using at least one sensor 140 deployed adjacent the microseismic event (fracture), and the ability to obtain a large amount of signals from the plurality of P-wave sensors in the linear array of fiber optic distributed sensors 190 extending along the length of the wellbore 16, would permit one of skill to more accurately determine the position of the signals from the desired microseismic event (fracture) while removing background noise. The fiber optic distributed sensors 190 are utilized for mapping the background noise in the wellbore, the noise mapping being useful to "clean up" the data obtained from the at least one sensor 140.

Further, because positioning of the microseismic event (fracture) is from within the wellbore 16, Applicant believes that only a minimal surface array or possibly no surface array is required. Further, if no surface array is required, there is no need for a velocity profile between wellbore 16 and surface.

In an embodiment, therefore, at least one 3-component sensor 140 is incorporated into the BHA 10 which is used for performing a fracturing operation and which is deployed into the wellbore on coiled tubing (CT).

More particularly, three orthogonally oriented geophones in each sensor 140 provide several benefits. The first is simply to account for the uncertainty in where the source of incident energy originated. By having 3 orthogonal geophones in each sensor 140, one is able to capture incident energy arriving from any direction. Since any single geophone is only capable of capturing motion in a single direction, at least 3 oriented orthogonally in each sensor 140 permit capturing motion in any one arbitrary direction.

Secondly, with the ability to detect motion in any direction, one can capture both compressional (P) waves, having particle motion in the direction of propagation, and shear (S) waves, having particle motion perpendicular to the direction of propagation, with equal fidelity.

Thirdly, by measuring the difference in arrival time between the observed compressional and shear wave arrivals for a single event, in combination with an understanding of the local velocity structure, a distance from the 3-component sensor 140 can be calculated for the origin of that event.

Fourthly, both azimuth and inclination of the waveform impinging on the sensor can be determined. By a process referred to as hodogram analysis, which involves cross-plotting the waveforms recorded on pairs of geophones, the direction of arrival at any 3-component sensor 140 can be determined, to within 180 degrees. Effectively, the vector defining the direction from which the energy impinged on a single 3-component sensor 140 would have a sign ambiguity. The direction of arrival could be either (x, y, z) or (−x, −y, −z).

By adding a second 3-component sensor 140 at some distance from the first sensor 140, directional ambiguity can be substantially eliminated. The second 3-component sensor 140 permits measurement of a time delay between the observed P or the observed S wave arrivals on each of the first and second 3-component sensors 140. One can then tell which of the two, possible arrival directions is the correct one. The only problem is if the event origin is located on the plane that bisects the first and second 3-component sensors 140, which, in reality, is most likely due to noise contamination, the region of ambiguity likely being larger than simply the bisecting plane. Adding a third 3-component sensor 140, spaced some distance from the first and second 3-component sensors 140, substantially eliminates the final uncertainty.

Further, at least one or more fiber optic distributed acoustic sensors 190 are operatively attached to an inside of the coiled tubing CT, as is understood in the art, and are spaced to extend along at least a portion of the length of the wellbore 16.

Noise, such as caused by the frac pumps, sliding sleeves, fluid movement through the CT 12 and the like, is readily transmitted by the metal CT 12. The fiber optic distributed sensors 190, in contact with a wall of the CT 12, readily detect the transmitted noise. A baseline can be obtained prior to turning on the pumps and initiating the fracturing operation to assist with mapping the noise once the operation is initiated. Furthermore, by actively monitoring the noise within the wellbore 16 using the linear array of fiber optic sensors 190, estimates of the noise at the at least one 3-component sensor 140 can be made. The noise estimates can then be subtracted from the 3-component sensor data, such as obtained during fracturing. Subtracting the noise from the 3-component sensor data effectively improves the ability of the 3-component sensors to detect a microseismic event resulting from the fracturing and a signature thereof.

As the fiber optic distributed sensors 190 are sensitive to tensile loading, the optical fibers are embedded in an adhesive or other material which is not compressible, but which is suitably flexible for CT operations. Thus, any strain changes imparted to the optical fibers are as a result of the microseisms and not to strain imposed by deploying the optical fibers in the CT 12.

In embodiments, surface probes such as in an array about the wellbore, are not required. Optionally however, a surface array of sensors can be used.

As shown in FIG. 9, three or more, 3-component-type geophones 140 are incorporated into the BHA 10. The three or more geophones 140 are spaced from each other along a length of the BHA 10 and are isolated from the flow of fracturing fluid, such as by being positioned downhole from the treatment head 55, incorporated therein.

Data collected by the geophones 140, situated in the wellbore 16 adjacent the fracturing events, can be transmitted to surface in real time, such as through the electronically-enabled CT 12 or the system can be operated in a memory mode, the data being stored in the geophones 140 for later retrieval.

As is understood by those skilled in the art, both power and signals can be transmitted using a single wire. In embodiments, a separate wire is incorporated in the electrically-enabled CT for operating the microseismic sensors 140 and a separate wire is incorporated for operating the other components of the BHA 10.

In embodiments, fiber optics incorporated into the electrically-enabled CT may be used to send data to surface from all of the BHA components, including the microseismic sensors 140.

Based upon conventional microseismic monitoring performed remote from the wellbore 16, one of skill would have thought it desirable to space the geophones as far apart as possible in the wellbore, such as by about 100 m, to provide optimum time resolution therebetween. Practically speaking however, when deployed with the BHA, the spacing between the geophones is limited by the size of the lubricator 160 at surface for injecting the BHA 10 into the wellbore 16. In embodiments, the geophones 140 are placed at least about 1 m apart. In embodiments, the geophones 140 are placed at about 5 m to about 10 m apart. However, because the geophones 140 are positioned so close to the fracturing events and because there is replication of the arrival times of both the compressional (p) and shear (s) waves at each of the geophones 140 permitting calculation of distance, calculation of velocity becomes less important and thus, the closer spacing is satisfactory. For example, in a conventional arrangement of sensors, a 10% error in velocity becomes significant by the time the signals reach a distant surface or observation well array. In embodiments disclosed herein however, when the geophones 140 are placed so close to the fracturing event, velocity becomes less significant, particularly as there are fewer intervening layers between the event and the sensors 140 through which the signal must pass.

Applicant believes that the frequency of noise generated through pumping of the fracture may be at a higher frequency than that of the microseismic event outside the wellbore (lower frequency). However, even if the frequencies are substantially similar, Applicant believes that the event can be recognized and any effects of the lower frequencies noise can be minimized, according to embodiments disclosed herein.

It is assumed that the acoustic noise, such as from fluid flows or travelling through metal casing 18, tubular and the like, are linear trends and that only one component of a 3 component geophone 140 will be affected by the noise. In reality, Applicant believes the other two components will likely also detect at least some of the noise.

As previously described, the three or more geophones 140 are coupled to the casing 18 or wellbore 16 and the orientation of each of the geophones 140 is known or can be mathematically adjusted for orientation and thereafter interpreted.

Applicant believes that the addition of the linear array of fiber optic sensors 190, used in combination with the three or more geophones 140 produces signals sufficiently clean to permit accurate determination of the position of the microseismic event within the formation 30. Noise mapped from the fiber optic sensors 190 is removed from the signals at each of the three geophones 140 and the clean signals are thereafter used to locate the microseismic event (fracture), as is understood by those of skill in the art.

Optionally, the sensors 140 may be decoupled from the remainder of the components of the BHA 10 to reduce noise associated therewith.

Monitoring of microseismic events in real time provides the ability to understand where the fracture is being positioned in the formation 30 and how the fracture is growing in all directions (x, y, z) relative to the pumping rates, the particular fracturing fluid and any number of other parameters with respect to the fracturing operation. The ability to rapidly optimize the design and placement of fractures provides the ability to build databases related thereto which may be of great use to the industry in improving fracture operations. Further, such information permits data, such as where the fluid has gone, to be provided for the public record regarding each stage of the fracturing operation and fracture location and extent.

Particularly advantageous, when monitoring in real time, is the ability to determine whether a fracture has broken out of a zone or is imminently in danger of breaking out of a zone so that pumping can be stopped. This is of great interest, for many reasons, where the fracture is breaking towards a water zone.

Growth of a fracture, vertically or horizontally at a certain rate, may be related to the pumping rate and concentration of the fracturing fluid. Over time and using the data obtained by embodiments disclosed herein, one could design a fracturing operation to achieve maximum vertical height without breaking out of the zone and maximum, economic horizontal displacement leading to horizontal well spacing optimization and field development optimization.

In the case of openhole wellbores 12, embodiments using microseismic monitoring as described herein are less susceptible to noise as there is less transmission of noise in the wellbore 16 without the casing or liner 18.

Additional Embodiments

Embodiments of the BHA's described above comprise substantially electrically-actuated tools. As one of skill in the art will appreciate however, embodiments are possible which utilize a combination of mechanically-actuated and electrically-actuated tools.

In an embodiment using electrically-enabled CT, mechanically-actuated fracturing tools, such as taught in Applicant's co-pending U.S. application Ser. No. 13/773,455 incorporated herein in its entirety, or other, conventional mechanically-actuated fracturing tools, may be combined with electrically-actuated perforating apparatus, as taught herein.

In yet another embodiment, using electrically-enabled and/or fiber optic-enabled CT, mechanically-actuated fracturing tools and perforating apparatus can be combined with microseismic monitoring apparatus as taught herein and which is operable in real time having data transmission to surface through the CT.

Embodiments utilizing electrically-enabled and/or fiber optic-enabled CT, mechanically-actuated fracturing tools and perforating apparatus combined with microseismic monitoring operated in a memory mode can use signals transmitted to surface through the fiber optics for minimizing noise in the data which is later retrieved from the BHA.

Diagnostic Testing

A minifrac test is an injection falloff diagnostic test that is performed for establishing formation pressure and permeability prior to pumping the main fracture stimulation. A short fracture is created during the injection of fluid, without proppant, and the fracture closure is observed during the ensuing falloff period. The minifrac is used to establish design parameters for the main fracture stimulation and is typically performed immediately prior thereto.

Using a BHA 10, according to an embodiment having the first and second variable diameter packers **22*f*,22*s* disclosed herein, the minifrac is pumped, and following pumping the minifrac, the first packer 22*f* is unset from the sealing position and the CT is unloaded with nitrogen. Thereafter, the first packer 22*f*** is reset to the sealing position and additional testing can be performed, such as the DFIT or NFIT test to monitor the fracture closure pressure, production, or the like.

Rock Stress Relief

Where adjacent zones in the formation 30 are to be fractured, there is concern that reductions in rock stress about a previously fractured zone might cause a fracture formed in the adjacent zone to break through to the previous fracture.

Having reference again to FIG. 6, and to minimize reductions in rock stress about the previous fractures, the valve 50 is actuated to permit fluid to be delivered through the bore 38 of the electrically-enabled CT 12 to the fluid crossover port 60 below the first packer **22*f*. The fluid F exits the fluid crossover port 60 to the annulus 34 below the first packer 22*f* and to the previously perforated and fractured zones therebelow to enter the perforations P and fractures to increase the rock stress about the previous fractures. In this case, while fluid F is delivered through the fluid crossover port 60, the fracturing fluid F is simultaneously delivered to the annulus 34 above the first packer 22*f* at suitable fracturing pressures for exiting the perforations P and fracturing the newly perforated, adjacent zone. In embodiments, clean fluid Fc is delivered through the electrically-enabled CT 12 to the annulus 34 below the first packer 22*f* to elevate the pressure P2 therein to be equal to or greater than the pressure P1 above the first packer 22*f***.

The ability to provide fluid F below the first packer **22*f* through the electrically-enabled CT 12 using the valve 50** provides a relatively simple means to avoid the problems related to reduced rock stress and which largely avoids the need for the complex, carefully orchestrated, simultaneous fracturing operations at multiple sites in side-by-side wellbores in a formation required according to prior art "zipper" fracturing techniques.

The embodiments in which an exclusive property or privilege is claimed are defined as follows:

1. A method of deploying and positioning a bottom hole assembly (BHA) in a wellbore comprising:

deploying the BHA into the wellbore, the BHA being electrically-enabled from surface and comprising at least one packer having an electrically-actuable packer element;

electrically actuating the packer element to expand to a running diameter being less than a diameter of the wellbore;

pumping fluid through an annulus between the wellbore and the BHA, the packer element acting as a hydraulic piston for pumping the packer and the BHA downhole in the wellbore; and electrically actuating the packer element to expand to a sealing diameter for sealing the annulus.

2. The method of claim 1 wherein the step of deploying the BHA, when encountering debris in the wellbore, further comprises:

electrically actuating the packer element to reduce to a minimum diameter less than the running diameter, to permit the debris to pass the at least one packer and BHA.

3. The method of claim 1 further comprising:

electrically-enabling the BHA from surface using one or more of wireline or multi-conductor cables.

4. The method of claim 1 wherein, after electrically actuating the packer element to expand to the sealing diameter for sealing the annulus, the method further comprises:

electrically actuating the packer element to reduce from the sealing diameter to the running diameter for relocating the BHA in the wellbore or tripping the BHA out of the wellbore.

5. The method of claim 4 wherein the BHA further comprises electrically connected pressure sensors above and below the at least one packer; and, after the step of electrically actuating the packer element to reduce from the sealing diameter to the running diameter for relocating the BHA in the wellbore or tripping the BHA out of the wellbore, the method further comprising:

monitoring the pressure data from the one or more pressure sensors at surface for determining when the pressure above the at least one packer and the pressure below the at least one packer are equalized prior to relocating or tripping the BHA.

6. The method of claim 1 wherein the wellbore is cased and has a plurality of spaced apart, ported sleeve subs incorporated therein, sleeves in the ported sleeve subs being actuable between a closed position for blocking one or more ports through the casing and an open position for opening the one or more ports for treating the formation therethrough, the method, prior to electrically actuating the packer element to expand to the sealing diameter for sealing the annulus, further comprising the steps of:

engaging the sleeve at the zone of interest with the BHA and actuating the BHA to move the sleeve to the open position;

positioning the at least one packer below the sleeve in the open position;

electrically actuating the packer element to expand to the sealing diameter for sealing the annulus therebelow;

pumping a treatment fluid through the annulus for delivery to the open ports and into the zone of interest;

stopping the pumping of the treatment fluid;

equalizing pressure across the at least one packer;

electrically actuating the packer element from the sealing diameter to the running diameter; and without removing the BHA from the wellbore, relocating the BHA in the wellbore; and repeating the steps for at least another zone of interest.

7. The method of claim 6, after at least the step of pumping the treatment fluid to the open ports, further comprises:

engaging the sleeve with the BHA and actuating the BHA to move the sleeve to the closed position.

8. The method of claim 7 wherein the engaging the sleeve at the zone of interest with the BHA and actuating the BHA to move the sleeve to the closed position comprises:

actuating a shifting tool in the BHA to engage and close the sleeve.

9. The method of claim 6 wherein the engaging the sleeve at the zone of interest with the BHA and actuating the BHA to move the sleeve to the open position comprises:

actuating a shifting tool in the BHA to engage and open the sleeve.

10. The method of claim 1, wherein the BHA further comprises one or more 3-component sensors, the method comprising:

monitoring microseismic events in the wellbore and outside the wellbore using the one or more 3-component sensors for collecting microseismic data from x, y and z.

11. The method of claim 10 wherein the one or more 3-component sensors are two or more 3-component sensors, electrically-enabled from surface, the method comprising:

transmitting the x, y and z data from the two or more 3-component sensors to surface, in real time.

12. The method of claim 11 further comprising:

electrically-enabling the two or more 3-component sensors from surface using one or more of wireline or multi-conductor cables.

13. The method of claim 10, wherein the one or more 3-component sensors are two or more 3-component sensors comprising storage memory and a battery, the method further comprising:

storing the x, y and z data from the two or more 3-component sensors in the storage memory; and retrieving the storage memory to surface with the BHA.

14. The method of claim 1 wherein the wellbore is cased and the BHA further comprises an electrically-actuated perforating gun downhole of the at least one packer, the perforating gun having a plurality of perforating segments electrically connected to a firing panel at surface for perforating the casing, the method, prior to electrically actuating the at least one packer to expand to a sealing diameter for sealing the annulus, further comprising:

electrically actuating, from the firing panel, a select one or more of the perforating segments.

15. The method of claim 1 wherein the wellbore is cased and the BHA further comprises a casing collar locator for positioning the BHA in the wellbore, further comprising:

engaging the casing collar locator with a casing collar adjacent a zone of interest for positioning the BHA.

16. The method of claim 15 wherein the casing collar locator is electrically enabled from surface, the step of positioning the BHA further comprises:

electrically sensing the casing collar or perforations in the wellbore at the zone of interest with the casing collar locator for positioning the BHA.

17. The method of claim 16 further comprising:

electrically-enabling the casing collar locator from surface using one or more of wireline or multi-conductor cables.

* * * * *